US008353682B2

(12) United States Patent
Patrascu et al.

(10) Patent No.: US 8,353,682 B2
(45) Date of Patent: Jan. 15, 2013

(54) MICROFLUIDIC-DEVICE SYSTEMS AND METHODS FOR MANUFACTURING MICROFLUIDIC-DEVICE SYSTEMS

(75) Inventors: Mihai Patrascu, Achel (BE); Mercedes Crego Calama, Geldrop (NL); Martijn Goedbloed, Geldrop (NL); Koray Karakaya, Eindhoven (NL)

(73) Assignee: Stichting IMEC Nederland, Eindhoven (NL)

( * ) Notice: Subject to any disclaimer, the term of this patent is extended or adjusted under 35 U.S.C. 154(b) by 722 days.

(21) Appl. No.: 12/274,120

(22) Filed: Nov. 19, 2008

(65) Prior Publication Data

US 2009/0129952 A1 May 21, 2009

Related U.S. Application Data

(60) Provisional application No. 60/989,636, filed on Nov. 21, 2007.

(30) Foreign Application Priority Data

Nov. 23, 2007 (EP) ..... 07076017

(51) Int. Cl.
*F04B 17/00* (2006.01)

(52) U.S. Cl. ..... 417/322; 417/412; 417/413.1; 417/413.2; 417/474

(58) Field of Classification Search ..... 417/322, 417/40, 207, 413.2
See application file for complete search history.

(56) References Cited

U.S. PATENT DOCUMENTS 5,171,132 A * 12/1992 Miyazaki et al. ..... 417/413.1
5,346,372 A 9/1994 Naruse et al.
6,074,178 A * 6/2000 Bishop et al. ..... 417/322
6,986,649 B2 * 1/2006 Dai et al. ..... 417/413.2
7,090,471 B2 8/2006 Xie et al.
7,104,768 B2 * 9/2006 Richter et al. ..... 417/423.2
8,056,881 B2 * 11/2011 Landers et al. ..... 251/129.06
2002/0114715 A1 8/2002 Yoon et al.

(Continued)

FOREIGN PATENT DOCUMENTS

EP 424087 A1 * 4/1991

(Continued)

OTHER PUBLICATIONS

European Search Report, European Application No. 08169675.9 dated Mar. 17, 2009.

(Continued)

*Primary Examiner* — Sikha Roy
(74) *Attorney, Agent, or Firm* — McDonnell Boehnen Hulbert & Berghoff LLP

(57) ABSTRACT

A microfluidic device is described. The microfluidic device comprises at least one transport channel and at least one working chamber, wherein the at least one transport channel and the at least one working chamber are separated from each other by a common deformable wall. The at least one transport channel is for containing a transport fluid and the at least one working chamber is for containing a working fluid. The microfluidic device comprises at least one pair of electrodes for changing the pressure on the working fluid such that when the pressure on the working fluid is changed, the deformable wall deforms, resulting in a change of the cross-section of the at least one transport channel. The working chamber comprises a flexible wall different from the common deformable wall and at least one electrode of the at least one pair of electrodes is provided on the flexible wall.

26 Claims, 12 Drawing Sheets

U.S. PATENT DOCUMENTS

| | | | | |
|---|---|---|---|---|
| 2002/0146330 | A1* | 10/2002 | Takeuchi et al. | 417/322 |
| 2004/0037718 | A1* | 2/2004 | Xie et al. | 417/413.2 |
| 2006/0102483 | A1* | 5/2006 | Chuang et al. | 204/605 |
| 2007/0209940 | A1* | 9/2007 | Krishnamoorthy et al. | 204/547 |

FOREIGN PATENT DOCUMENTS

| | | | |
|---|---|---|---|
| EP | 1844936 | A1 | 10/2007 |
| WO | 0194920 | A2 | 5/2001 |
| WO | 02/081935 | | 10/2002 |
| WO | 9617172 | A1 | 11/2008 |

OTHER PUBLICATIONS

European Search Report from Related Application No. EP 07 07 6017, dated Apr. 21, 2008.

* cited by examiner

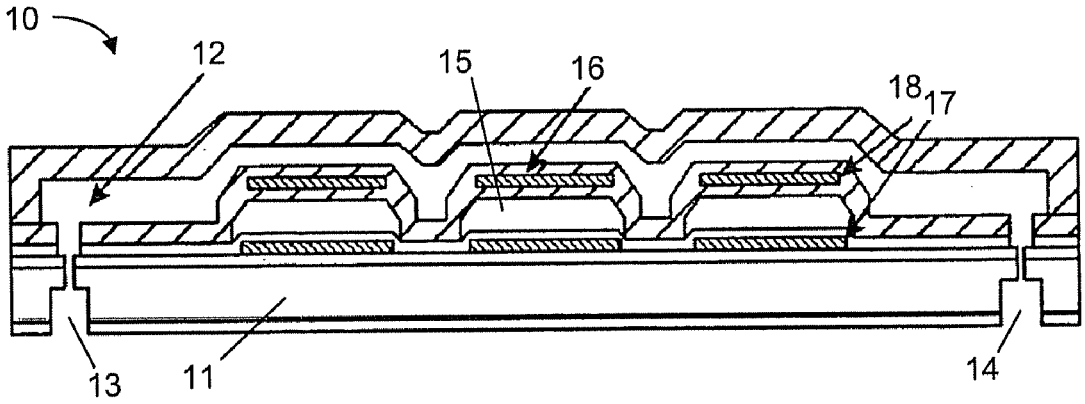
Fig. 1 - Prior art
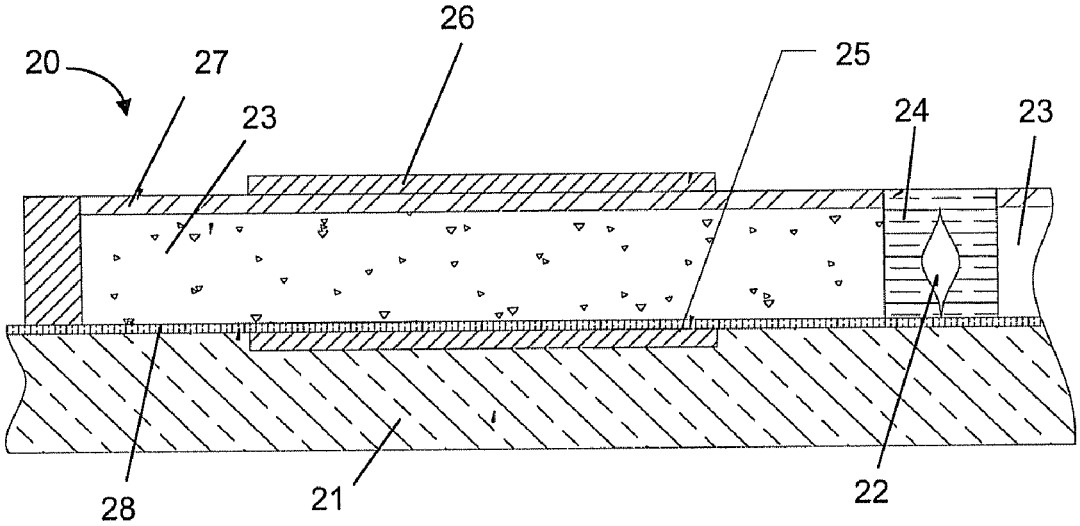
Fig. 2
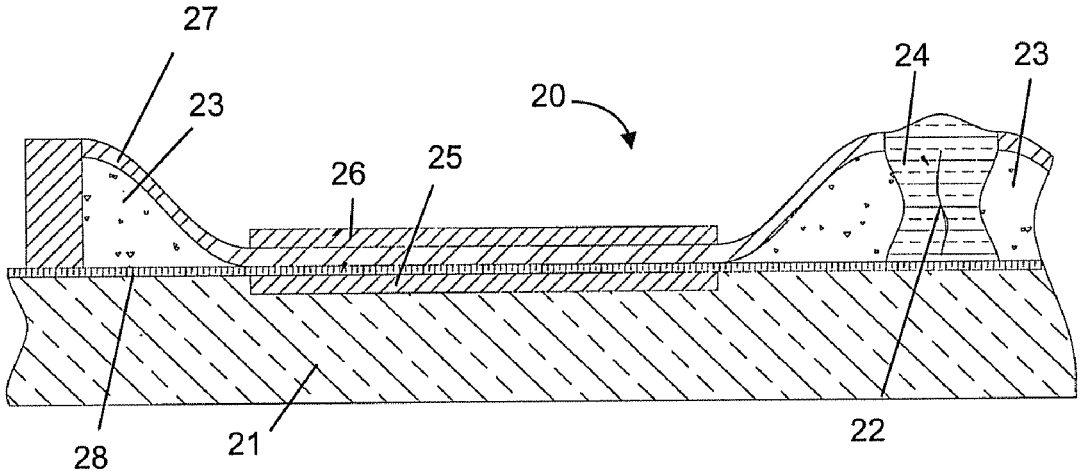
Fig. 3

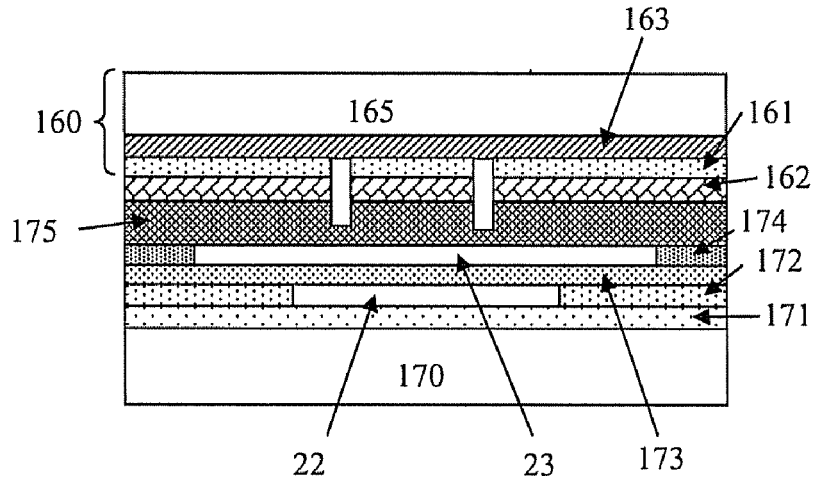
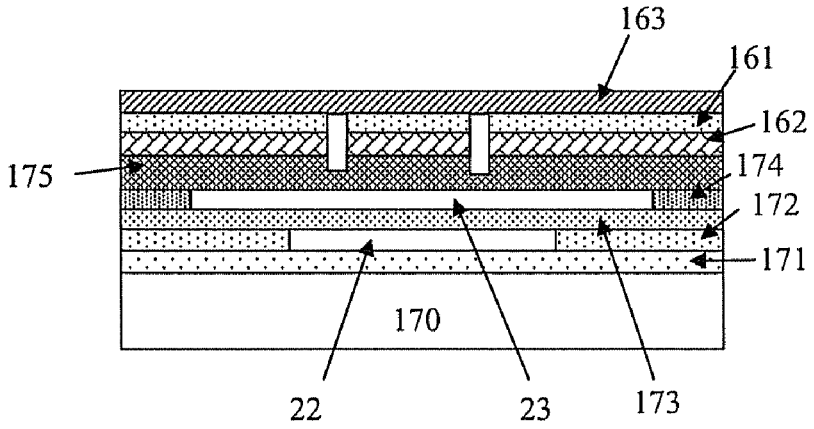
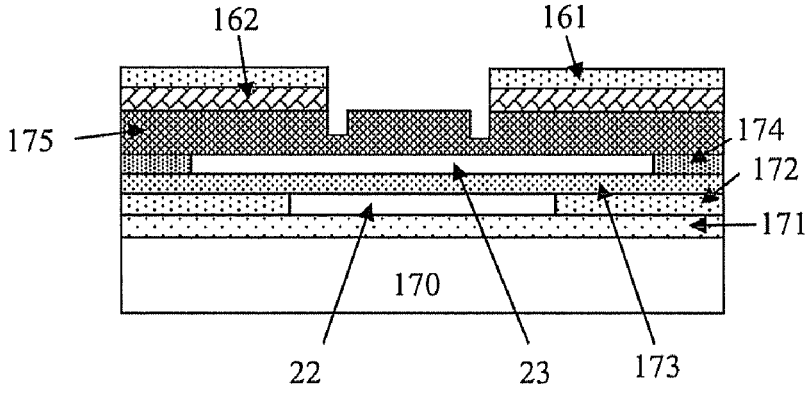
Fig. 18

MICROFLUIDIC-DEVICE SYSTEMS AND METHODS FOR MANUFACTURING MICROFLUIDIC-DEVICE SYSTEMS

RELATED APPLICATIONS

This application claims priority under 35 U.S.C. §119(e) to U.S. Provisional Patent Application Ser. No. 60/989,636, filed on Nov. 21, 2007 and under 35 U.S.C. §119(b) to European Patent Application EP 07076017.8, filed on Nov. 23, 2007, the full disclosures of which are incorporated herein by reference.

FIELD

The present disclosure relates generally to the field of microfluidics, and more particularly, relates to a microfluidic device.

BACKGROUND

Fabrication of fluidic pumping devices, and more particularly fabrication of valves in such pumping devices, is a difficult aspect in the development of microfluidic systems.

Various efforts have been undertaken in order to develop such pumps. For instance U.S. Pat. No. 7,090,471 shows a possible implementation, an embodiment of which is illustrated in FIG. 1. A valve device of fluid regulating element 10 is disposed on a substrate 11. The fluid regulating element 10 includes a fluid channel 12 including an inlet 13 at a first end for receiving a liquid and an outlet 14 at a second end, the fluid channel 12 being disposed overlying the substrate 11. An actuation region 15 filled with air is disposed overlying the substrate 11 and coupled to the fluid channel 12. A polymer based diaphragm 16 is coupled between the fluid channel 12 and the actuation region 15. A first electrode 17 is coupled to the substrate 11 and to the actuation region 15. A second electrode 18 is coupled to the polymer based diaphragm 16. An electrical power source is coupled between the first electrode 17 and the second electrode 18 to create an electrostatic field between the first and second electrodes 17, 18. When applying such potential difference, the air in the actuation region 15 is being compressed, which causes the polymer-based diaphragm 16 to move towards the substrate 11, thus generating an under pressure in the fluid channel 12 and acting as an active, i.e. controlled, valve for the fluid channel 12.

In the above solution, actuation force is restricted by the electrode plate area, as the active part of the electrode plate area is constrained by the channel width. In other words, the actuation force is restricted by the projection of the electrode plate area on the channel wall. Further, in the above solution the fluid channel cannot be completely closed.

WO 96/17172 discloses an integrated electrical discharge microactuator, in which an electric field is generated between electrodes, which electric field generates an electrical discharge in a gas (working fluid) in a chamber. This electrical discharge modifies the state parameters (e.g., temperature, density, pressure, and speed) of the gas, and such modification provides a deformation of a common membrane between a working chamber and a pumping chamber. In this microactuator, the pumping chamber cannot be completely closed.

SUMMARY

The present disclosure describes a microfluidic pumping device and methods for performing microfluidic pumping.

In a first aspect, an embodiment provides a microfluidic device, e.g. a microvalve, comprising at least one transport channel and at least one working chamber. The at least one transport channel and the at least one working chamber may be separated from each other by a common deformable wall. The at least one transport channel may be for containing a transport fluid and the at least one working chamber may be for containing a working fluid. The microfluidic device comprises at least one pair of electrodes, e.g. one or more pairs of piezoelectric electrodes and/or one or more pairs of electrostatic electrodes, for changing, e.g. increasing or decreasing, the pressure on the working fluid such that when the pressure on the working fluid is changed, e.g. the working fluid is put under pressure, the deformable wall deforms, resulting in a change of the cross-section of the at least one transport channel. In embodiments of the present invention, the at least one pair of electrodes is located against sidewalls of the at least one working chamber, away from the at least one transport channel. The electrodes are positioned on the walls of the working chamber, away from the at least one transport channel, meaning that the electrodes do not directly contact any of the sidewalls of the transport channel. The working chamber may comprise a flexible wall different from the common deformable wall. At least one electrode, e.g. at least one electrode of the at least one pair of electrodes, may be provided on the flexible wall, in direct or indirect physical contact therewith. There does not need to be direct contact between an electrode of the at least one pair of electrodes and the flexible wall. For example, one or more intermediate flexible layers of material may be present between both.

It is an advantage of embodiments of the present invention that, when the microfluidic device is in use, no electrical field is applied over the transport fluid.

It is an advantage of microfluidic devices according to embodiments of the present invention that they have a high performance in terms of pressure build-up, fluid throughput and backflow at stationary conditions because of i) presence of separate working and transport fluids, and ii) the possibility to totally or substantially squeeze (close) the at least one transport channel, thereby preventing backflow. In case of electrostatic actuation, the electrostatic force generated is inversely proportional to the second power of the distance between the electrodes of a pair of electrodes. Therefore, the closer the two actuation electrodes come with respect to each other, the higher the force becomes to totally or substantially squeeze the channel.

It is an advantage of microfluidic devices according to embodiments of the present invention that they have a high throughput. It is a further advantage of microfluidic devices according to embodiments of the present invention, in particular e.g. for drug delivery systems and the like, that while having a high throughput, they can accurately deliver doses of fluid.

According to embodiments of the present invention, where the microfluidic device comprises a pair of electrostatic electrodes (electrostatic actuation), electrodes of such a pair of electrodes may be positioned on opposite sides of the at least one working chamber. For example, such electrodes may be positioned at a bottom side and a top side of the at least one working chamber. The electrodes are positioned on the walls of the working chamber, away from the at least one transport channel, meaning that the electrodes do not directly contact any of the sidewalls of the transport channel.

According to alternative embodiments of the present invention, the microfluidic device may comprise a piezoelectric actuator, the piezoelectric actuator comprising a first piezoelectric electrode, at least one piezoelectric layer comprising a piezoelectric material and a second piezoelectric electrode. The piezoelectric actuator may be provided on the flexible wall of the working chamber. The first piezoelectric electrode and the second piezoelectric electrode may be positioned at opposite sides of the at least one piezoelectric layer. Alternatively, the first piezoelectric electrode and the second piezoelectric electrode may be positioned at a same side of the at least one piezoelectric layer and they may be interdigitated.

According to embodiments of the present invention, a plurality of working chambers may be associated with the at least one transport channel. At least two working chambers may be provided at opposite sides of a transport channel.

A microfluidic device according to embodiments of the present invention may comprise at least one electrode of the at least one pair of electrodes which is provided on a flexible wall of the at least one working chamber, in direct or indirect physical contact with the flexible wall.

In a microfluidic device according to embodiments of the present invention, the deformable wall may comprise or may be made from polymer material.

In a microfluidic device according to embodiments of the present invention, the at least one fluid channel may contain a transport liquid.

In a microfluidic device according to embodiments of the present invention, the at least one working chamber may contain a working liquid. The working liquid may have an electrical permittivity larger than 1.

A microfluidic device according to embodiments of the present invention may further comprise a pressure compensator, for example for keeping the working fluid pressure within limits, and for avoiding damage such as leakage, delamination of biocompatible layers on the piezoelectric actuators.

In a second aspect, an embodiment of the present invention provides a micropump comprising a plurality of microfluidic devices according to embodiments of the present invention. A micropump according to embodiments of the present invention may be adapted to be driven as a peristaltic micropump.

In a third aspect, an embodiment of the present invention provides a method for manufacturing a microfluidic device. The method comprises providing at least one transport channel suitable for containing transport fluid; providing at least one working chamber suitable for containing working fluid, the working chamber having a flexible wall; providing a common deformable wall between the at least one transport channel and the at least one working chamber, the common deformable wall being different from the flexible wall; and providing, against sidewalls of the at least one working chamber, away from the at least one transport channel, at least one pair of electrodes adapted for changing, e.g. increasing, the pressure on the working fluid in the at least one working chamber, wherein providing the at least one pair of electrodes comprises providing at least one electrode of the at least one pair of electrodes against the flexible wall. Providing at least one electrode of the at least one pair of electrodes against the flexible wall may comprise providing the at least one electrode in direct or indirect physical contact with the flexible wall. In embodiments of the present invention, one or more flexible layers of material may be provided between the flexible wall and the electrode.

In embodiments of the present invention, providing at least one pair of electrodes may comprise providing at least one pair of piezoelectric electrodes.

In alternative embodiments of the present invention, providing at least one pair of electrodes may comprise providing at least one pair of electrostatic electrodes.

Providing at least one electrode pair may comprise providing at least one electrode of the at least one electrode pair against the flexible wall, in direct or indirect physical contact therewith.

In a further aspect, an embodiment of the present invention provides the use of a microfluidic device according to embodiments of the present invention, or of a micropump according to embodiments of the present invention in any of drug delivery, lab-on-a-chip or cooling application.

Embodiments of the present invention provide micro pumps that are biocompatible and flexible. Flexible in embodiments of the present invention, may mean that that the micro pumps can be wearable, such that they can for instance adapt to body motion—similar to, for example, cloth. They can be worn without or with minimal discomfort, from a mechanical point of view. This is true if a flexible substrate is used, which may be an option. This holds for the micro pump. If the whole system is considered, then the flexibility may depend on other factors as well, such as the electronics and power delivery system. But devices according to embodiments of the present invention device enable flexibility in this sense. Micro pumps according to embodiments of the present invention can deliver tiny amounts of liquids with high accuracy, e.g. amounts in the order of a few (e.g., tens) of nl to hundreds of nl per minute.

The tiny amounts may be delivered because the valve volumes are small, especially the inter electrode distance of only about one or two microns. Assuming plates of 0.5 mm×0.5 mm, a total valve volume of 2.5 to 5.10^(−13) $m^3$ is obtained, or 0.25-0.5 nl per sequence as an upper limit for the given dimensions. A 100 Hz (high estimation) pumping rate would yield up to 25 or 50 nl/s or 1500 nl/minute upper limit. Accuracy of micro pumps according to embodiments of the present invention can be higher than the accuracy of prior art devices, because in the design according to embodiments of the present invention valves close totally or substantially when actuated, whereas the prior art designs have half-closed valves (not actuated) or totally opened (actuated) valves. This means that in devices according to embodiments of the present invention, a higher (back) pressure can be built than in the other case. A higher pressure means that a device according to embodiments of the present invention may be less sensitive to pressure difference between inlet and outlet.

It is an advantage of embodiments of the present invention that substantially no or even no backflow can take place if the valve is not actuated, because a neighboring valve may be substantially, substantially completely or even completely closed.

It is an advantage of embodiments of the present invention that electrostatic actuation is used, which provides dielectric losses which are very low compared to other actuation principles such as thermal actuation and electro-osmotic actuation. Therefore, microfluidic devices according to embodiments of the present invention may achieve a high efficiency.

It is an advantage of other embodiments of the present invention that piezoelectric actuation is used, in which performance is not influenced by the height of the working chamber and/or transport channel.

Although there has been constant improvement, change and evolution of devices in this field, the present concepts are believed to represent substantial new and novel improvements, including departures from prior practices, resulting in the provision of more efficient microfluidic pumping devices.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings. Further, it is understood that this summary is merely an example and is not intended to limit the scope of the invention as claimed.

BRIEF DESCRIPTION OF THE DRAWINGS

Presently preferred embodiments are described below in conjunction with the appended drawing figures, wherein like reference numerals refer to like elements in the various figures, and wherein:

FIG. 1 is a simplified cross-sectional view diagram of a prior art peristaltic pump;

FIG. 2 is a cross-sectional view of a microfluidic device in accordance with an embodiment, in non-actuated state;

FIG. 3 is a cross-sectional view of the microfluidic device of FIG. 2, in actuated state;

FIG. 18 illustrates bonding a piezoelectric device as obtained by the work flow illustrated in FIG. 16 with a microfluidic wafer as obtained by the work flow illustrated in FIG. 17, and finalizing the device with bulk micromachining for releasing the piezoelectric actuators.

DETAILED DESCRIPTION

Figure 4:
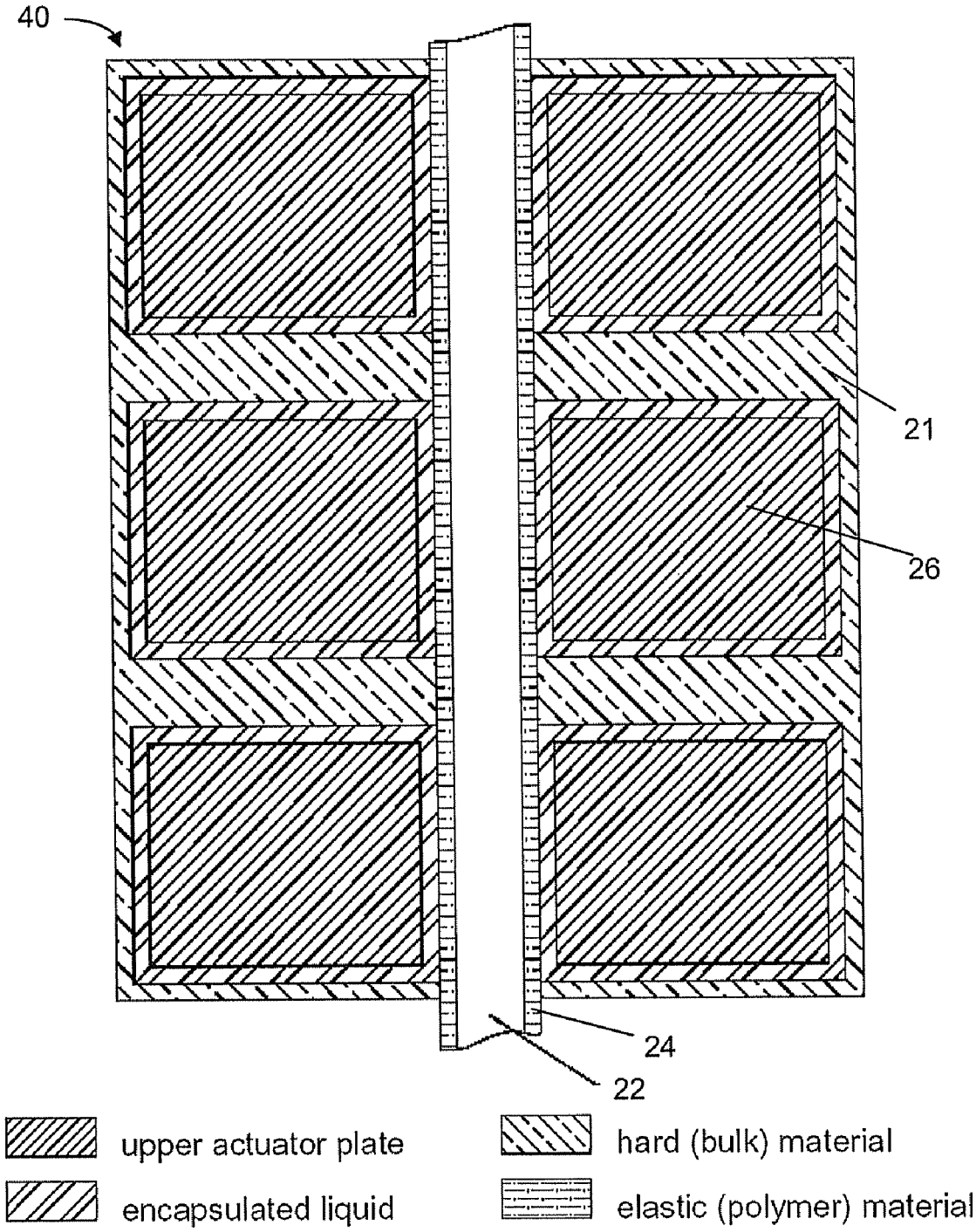
FIG. 4 is a top view of a microfluidic pump in accordance with an embodiment.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The absolute and relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B.

Similarly, it is to be noticed that the term "coupled", also used in the claims, should not be interpreted as being restricted to direct connections only. The terms "coupled" and "connected", along with their derivatives, may be used. It should be understood that these terms are not intended as synonyms for each other. Thus, the scope of the expression "a device A coupled to a device B" should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

The invention will now be described by a detailed description of several embodiments of the invention. It is clear that other embodiments of the invention can be configured according to the knowledge of persons skilled in the art without departing from the technical teaching of the invention, the invention being limited only by the terms of the appended claims.

In the context of the present disclosure, a valve is a subsystem that can be used for controlling (e.g., passing or blocking) the flow of a fluid through a channel. A pump is a system that may comprise one or more valves and that can be used to transport a fluid.

According to an embodiment of the present invention, and as illustrated for a first embodiment in FIG. 2, a microfluidic device 20 is provided. The microfluidic device 20 comprises a substrate 21, a transport channel 22 and a working chamber 23 separated from each other by a common deformable wall 24. In embodiments of the present invention, the term "substrate" may include any underlying material or materials that may be used, or upon which a device may be formed. In other alternative embodiments, this "substrate" may include a semiconductor substrate such as e.g. silicon, a gallium arsenide (GaAs), a gallium arsenide phosphide (GaAsP), an indium phosphide (InP), a germanium (Ge), or a silicon germanium (SiGe) substrate. The "substrate" may include, for example, an insulating layer such as a $SiO_2$ or a $Si_3N_4$ layer in addition to a semiconductor substrate portion. Thus, the term substrate also includes silicon-on-glass, silicon-on sapphire substrates. The term "substrate" is thus used to define generally the elements for layers that underlie a layer or portions of interest, in particular a microfluidic device 20. Also, the "substrate" may be any other base on which a microfluidic device is formed (for example a glass, quartz, fused silica or metal foil). A flexible and optionally even a transparent system can be achieved by having suitable polymers as bulk and structural materials.

The transport channel 22 may be suitable for containing a transport fluid, e.g. a first liquid such as e.g. ethanol, water or any other suitable fluid (for example, a low-viscosity fluid). The working chamber 23 may be suitable for containing a working fluid, e.g. a second liquid such as e.g. purified water. Due to the deformable wall 24 between the transport channel 22 and the working chamber 23, there is no direct contact between the working fluid and the transport fluid.

The microfluidic device 20 may comprise means for increasing the pressure on the working fluid in the working chamber 23 such that, when the working fluid is put under pressure, the deformable wall 24 between the working chamber 23 and the transport channel 22 deforms, resulting in a change in the cross-section of the transport channel 22 (for example, resulting in a reduction in cross-section of the transport channel 22). In other words, in embodiments of the present invention, upon increasing the pressure on the working fluid in the working chamber 23, the transport channel 22 is squeezed, and at least partially closed and optionally completely closed. The means for increasing the pressure on the working fluid, in embodiments of the present invention, comprises a first electrode 25 and a second electrode 26, located at opposite sides of the working chamber 23. The first and second electrodes 25, 26 are plate electrodes. They may be made from any suitable conductive material (e.g. they may be metal electrodes or highly conductive polymer electrodes). The electrodes may, for example, comprise a material selected from the group consisting of gold, aluminium, platinum, chrome, titanium, and doped poly-silicon. They may comprise a sandwich of layers of conductive materials, e.g. a Cr/Al/Cr sandwich. They may have an arbitrary shape. However, for the sake of optimal performance, they may have a substantially identical shape and may be aligned one on top of the other. They may, for example, have a rectangular shape, a square shape, a circular shape, or any other suitable shape. As the electrodes 25, 26 can have arbitrary dimensions, the working fluid to be moved can be divided over a larger electrode area. Hence a smaller inter-electrode distance is possible, and hence smaller actuation signals may be used to obtain a same pressure by the working fluid on the transport fluid. The electrodes 25, 26 are located against opposite sidewalls of the working chamber 23, away from the transport channel 22. With "away from the transport channel 22" is meant that the first and second electrodes 25, 26 do not directly contact any of the sidewalls of the transport channel 22. The actuation principle in these embodiments is electrostatic actuation.

An advantage of using liquids rather than gasses as a working fluid is that the liquids are less compressible than gasses; hence actuation of electrodes 25, 26 will typically always result in a change in cross-section of the transport channel 22, provided the system is such that the moved quantity of liquid due to change of shape of the working chamber 23 is sufficient to squeeze the transport channel 22.

In the embodiment illustrated in FIG. 2, the first electrode 25 is provided on or in the substrate 21, which forms the bottom wall of the working chamber 23. The top wall 27 of the working chamber 23 is formed by a flexible or elastic material such as e.g. polyimide, parylene, SU-8, PDMS or BCB. The deformable wall 24 between the working chamber 23 and the transport channel 22 and the flexible top wall 27 of the working chamber 23 may be made, but do not need to be made, out of different materials. They may have, but do not need to have, different properties. For example, they may have different flexibility. The working chamber 23 has at least one flexible wall, apart from the deformable wall 24. At least one of the electrodes 25, 26 is provided against the flexible wall. Due to the provision of one of the electrodes against a flexible wall, this electrode 26 can move in the direction to and from the other electrode 25, e.g. up and down, depending on the actuation state (on/off). In the embodiment illustrated, the second electrode 26 is provided against the flexible top wall 27 of the working chamber 23. In other embodiments, one of the electrodes can be mounted against a flexible bottom wall of the microfluidic device. In yet other embodiments, both first electrode 25 and second electrode 26 can be mounted against flexible walls, e.g. against a flexible bottom wall and a flexible top wall, respectively, or against two opposite sidewalls.

In the examples illustrated, electrodes 25, 26 are provided against top and bottom walls of the working chamber 23.

This, however, is not intended to be limiting to the invention. In alternative embodiments, the electrodes can be provided e.g. against vertical sidewalls. In the embodiments illustrated, the second electrode 26 is provided at the outer side of the flexible top wall 27, with respect to the working chamber 23, i.e. the second electrode 26 is provided at the outer side of the working chamber 23. Also the first electrode 25 is provided at the outer side of the working chamber 23. In order to obtain this, an insulating layer 28 may be provided between the first electrode 25 and the working fluid in the working chamber 23.

Providing actuation electrodes 25, 26 at either side of a working chamber 23 rather than at either side of the transport channel 22 has the advantage that no electrical fields are applied to the transport fluid. This can be beneficial to avoid electrolysis of the fluidic contents of the transport channel. This may also be advantageous in avoiding the negative effects of imposing an electrical field upon contents of the transport channel 22 that are sensitive to such an applied field, for example cells or electrically polar tags or solvents.

Providing actuation electrodes 25, 26 at either side of a working chamber 23 away from the transport channel 22 furthermore has the advantage that the electric field between the actuation electrodes 25, 26 is independent of the transport fluid permittivity and the transport wall 24 material permittivity, but depends on the working fluid and its properties (e.g. permittivity). In embodiments of the present invention, the transport fluid permittivity of the transport fluid does not influence the performance of the microfluidic device. The working fluid is confined within a closed volume, the working chamber 23, such that when a force is being applied on the side(s) of this volume, the structure changes shape due to the working fluid incompressibility.

Providing actuation electrodes 25, 26 at either side of a working chamber 23 away from the transport channel 22 has the further advantage that larger working chambers 23 and therefore larger actuation electrodes 25, 26 can be used. Therefore, the actuation force, which is restricted by the electrode plate area, is not constrained by the channel width in accordance with embodiments of the present invention, but can be varied according to various requirements. Hence larger actuation forces can be applied to the transport channel wall 24.

FIG. 2 illustrates an embodiment of a non-actuated microfluidic device 20, where the transport channel 22 is open and thus in a transport state allowing transport fluid to pass through. FIG. 3 illustrates another state of microfluidic device 20—namely, an actuated state. A sufficiently large electrical field is applied between the first and second electrodes 25, 26, which have collapsed towards each other, thus deforming the working chamber 23. Under pressure of the working fluid in the working chamber, which is displaced by the force applied by the first and second electrodes 25, 26, the deformable wall 24 between the working chamber 23 and the transport channel 22 is deformed. This deformation changes the cross-section of the transport channel 22. The change in cross-section in this embodiment is a reduction in the cross-section. The reduction in cross-section may be so as to at least partly, and optionally substantially completely or completely, close the transport channel 22. In a completely closed state or substantially completely closed state, substantially no transport fluid can pass through the transport channel 22, and preferably no transport fluid at all can pass through.

In accordance with embodiments of the present invention, such microfluidic device 20 may act as a valve in a microfluidic system.

According to another embodiment of the present invention, a microfluidic pumping device 40 is provided. The microfluidic pumping device 40 may comprise at least one, and optionally a plurality of microfluidic valves 20 in accordance with embodiments of the present invention. Transport fluid displacement is obtained in a microfluidic pumping device by locally confining the channel cross-section, and subsequently doing this along the length of the transport channel 22.

FIG. 4 shows a schematic top view of an embodiment of such a microfluidic pumping device 40. Along a channel 22 with flexible walls 24, a plurality of working chambers 23 (not illustrated in FIG. 4 because hidden by the second electrodes 26) are provided. Each of the working chambers 23 shares the flexible wall 24 with the channel 22. The working chambers 23 are provided with first electrodes 25 (also hidden in FIG. 4) and second electrodes 26 (only the top one visible in the top view of FIG. 4) for actuation of the working fluid in the working chambers 23. In the embodiment illustrated, pairs of working chambers 23 are provided at either side of the transport channel 22. These pairs of working chambers 23 may be actuated on both sides of the transport channel 22 symmetrically. In alternative embodiments, as discussed below, one or more working chambers 23 can be provided at one side of the transport channel 23 only. In the embodiment illustrated in FIG. 4, the pairs of working chambers 23 can be actuated so as to co-operate in regulating the fluid flow through the transport channel 22. Both working chambers 23 of a pair can, for example, be actuated at the same time or substantially the same time to completely close or substantially completely close the transport channel 22. Alternatively, only one working chamber 23 of a pair can be actuated in order to reduce the cross-section of the transport channel 22 rather than closing it off completely. In still alternative embodiments, both working chambers 23 of a pair can be synchronously actuated so as to only partially close the transport channel 22.

In the embodiment illustrated in FIG. 4, all working chambers 23 have the same dimensions. However, in accordance with alternative embodiments, chambers 23 with different sizes may be provided along the channel 22. As an example, the volumes of both the first and the last (set of) valves does not matter, as long as their flow resistance is low (opened state) when they are off and very high (not completely open, preferably closed) when they are on. Relatively small areas are sufficient for the outer valves (e.g. working chamber 23*a*, 23*b*, 23*e*, 23*f* in FIG. 5), whereas the inner valves (e.g. working chambers 23*c*, 23*d* in FIG. 5) preferably are as large as possible, to contain as large an amount of transport fluid per cycle as possible. Another advantage of having small outer valves is that they need to displace smaller amounts of liquids, thus reducing settling times. Moreover, the saved electrode area can be used by the bigger, middle valve(s), e.g. 23*c*, 23*d* in FIG. 5.

Figure 5:
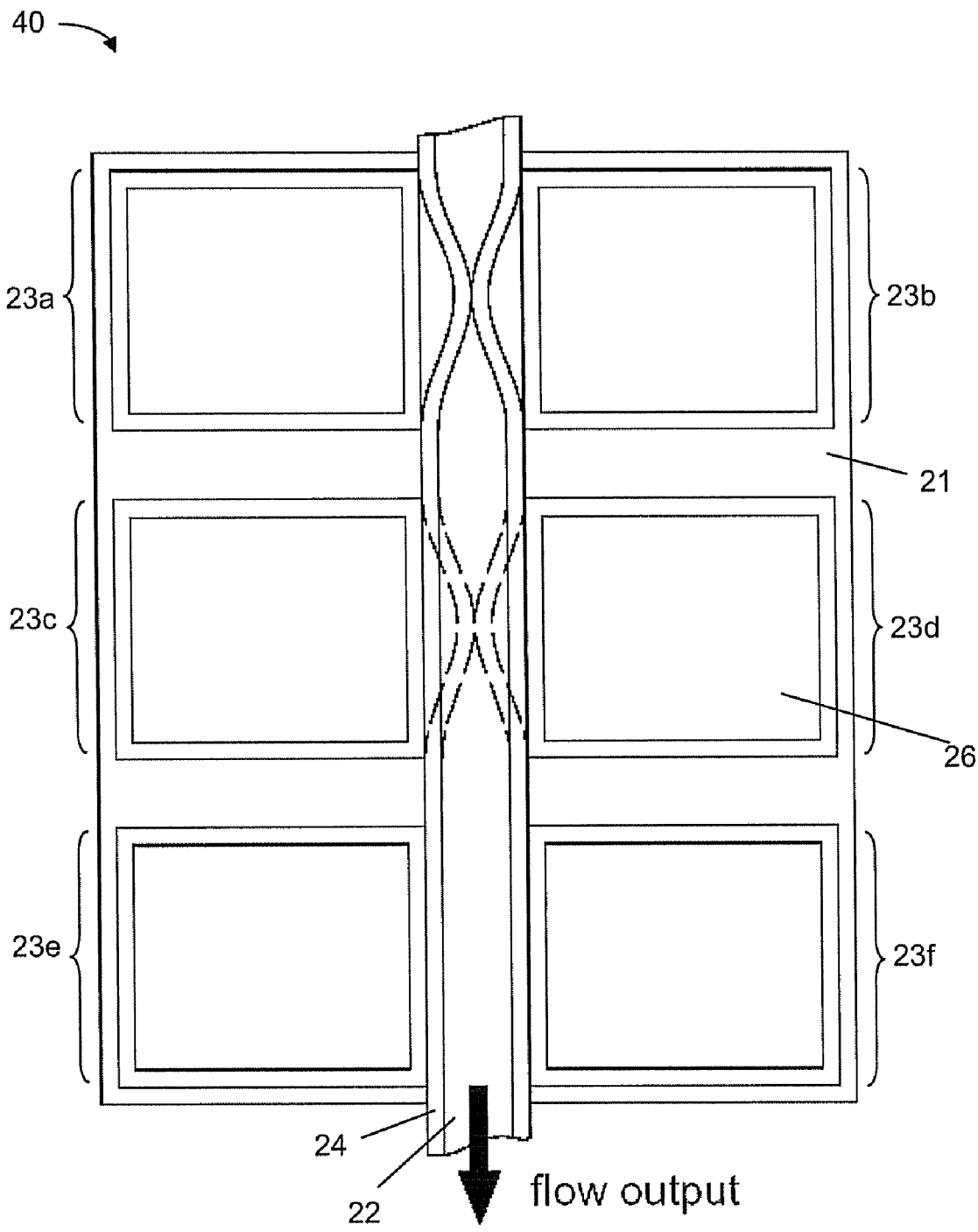
FIG. 5 is an illustration of an operation principle of the microfluidic pump of FIG. 4.

FIG. 5 illustrates operation of a microfluidic pumping device 40 as in FIG. 4. The pumping device 40 illustrated in FIG. 5 comprises six working chambers 23*a*, 23*b*, 23*c*, 23*d*, 23*e*, 23*f* located in pairs 23*a*, 23*b*; 23*c*, 23*d*; 23*e*, 23*f* at opposite sides against the flexible walls 24 of the transport channel 22. Each working chamber 23*a*, 23*b*, 23*c*, 23*d*, 23*e*, 23*f* comprises a first electrode 25 (not visible in FIG. 5) and a second electrode 26 as illustrated in FIG. 2. Upon actuation of the first and second electrodes 25, 26 of the first and second working chambers 23*a*, 23*b*, these working chambers 23*a*, 23*b* deform, for example as illustrated in cross-section in FIG. 3, thus causing deformation of the flexible wall 24 between the working chambers 23*a*, 23*b* and the transport channel 22. This deformation of the flexible wall 24 causes the cross-section of the transport channel 22 to change and, in particular, to reduce. In the embodiment illustrated in FIG. 5, it even causes the transport channel 22 to close completely. A quantity of transport fluid which was located, before actuation of the first and second electrodes of the working chambers 23*a*, 23*b*, in the transport channel 22 in between these working chambers 23*a*, 23*b*, is displaced inside the transport channel 22 due to the actuation of the first and second electrodes 25, 26 and the corresponding deformation of the flexible wall 24. The quantity of transport fluid may be moved in a flow direction.

A flow of transport fluid may be moved through the microfluidic pumping device 40 by subsequent actuation of electrodes 25, 26 of subsequent working chamber pairs 23*a*, 23*b*; 23*c*, 23*d*; 23*e*, 23*f*. The subsequent actuation provides peristaltic propulsion. This is illustrated as an example in FIG. 6. In the embodiment illustrated, a peristaltic motion may be obtained by actuating parts, e.g. working chamber pairs, along the channel 22 in a reciprocal motion, i.e. in a way such that after one cycle, the original shape of the pumping device 40 is restored. By 'actuating parts along the channel 22' is meant for instance that working chambers 23*a*, 23*b*; 23*c*, 23*d*; 23*e*, 23*f* in a pair in FIG. 5 are being actuated and relaxed at the same time, as if it were only one part. It is to be noted that this is only an embodiment, so that in the general case any shape of volume or combination of volumes around the transport channel 22 could be used to generate peristaltic motion.

Figure 6:
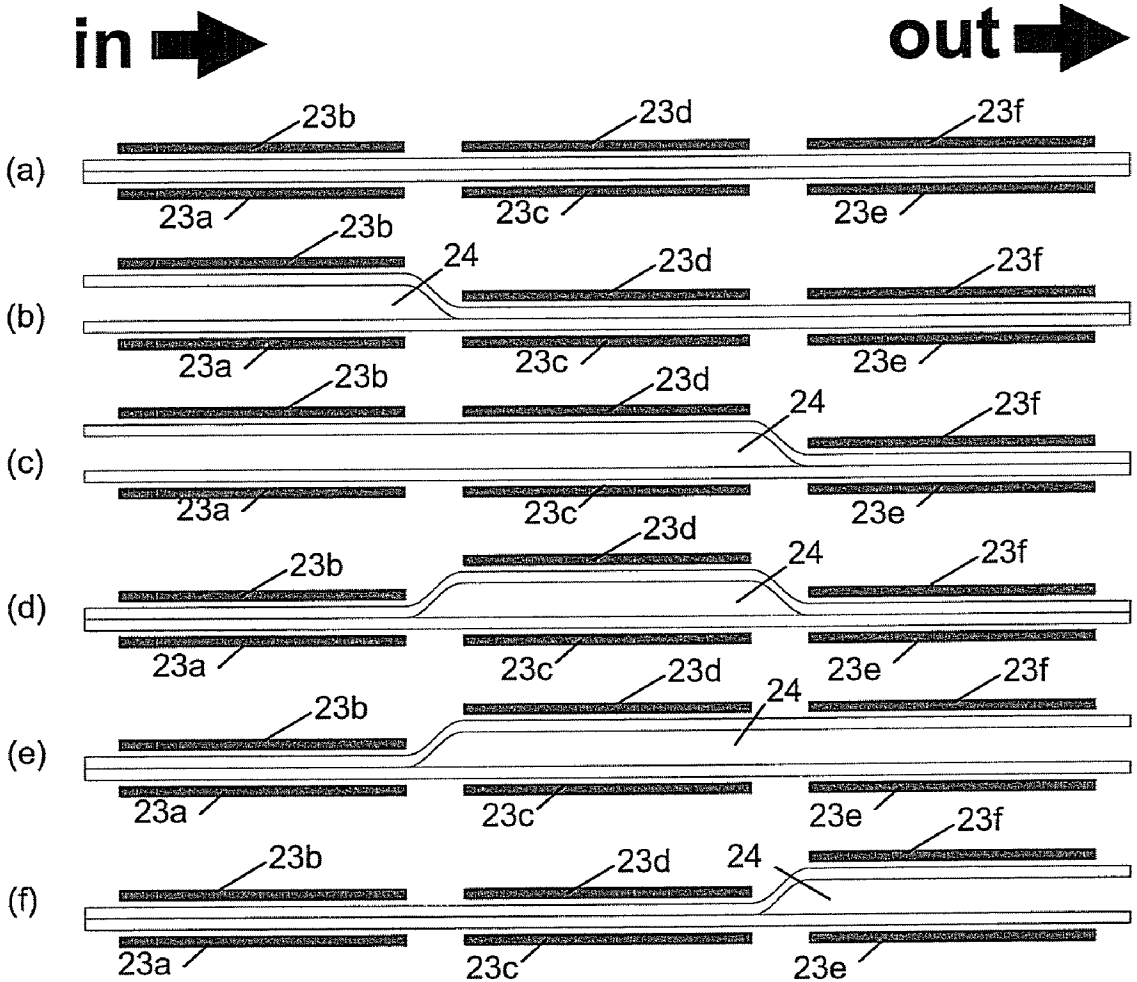
FIG. 6 schematically illustrates an operation principle which can be obtained with a device in accordance with embodiments; for purposes of clarity, FIG. 6 does not illustrate details of the working chambers and their electrodes.

To illustrate the peristaltic movement, the target of moving an amount of fluid equivalent to one valve's volume from a reservoir upstream of the micropumping device 40, to another one downstream the pumping device 40 is considered (FIG. 5). The pumping device 40 comprises three pairs of working chambers 23*a*, 23*b*; 23*c*, 23*d*; 23*e*, 23*f* adjacent the transport channel 22. One of the many possible ways to achieve the goal of transporting fluid between the reservoirs (not illustrated) is presented by means of the different steps in FIG. 6. FIG. 6 is schematic only, for illustrating which parts of the pumping device are actuated to obtain peristaltic pumping; it does not show working chambers and their electrodes in detail, but only includes actuated and non-actuated working chambers at top and bottom of the transport channel for clarity.

Step (a): the sequence starts having actuated all pairs of working chambers 23*a*, 23*b*; 23*c*, 23*d*; 23*e*, 23*f*, so that the channel 22 is closed by the three pairs of working chambers.

Step (b): the first pair of working chambers 23*a*, 23*b* are being released, thereby opening a first portion of the channel 22 (flow resistance of transport channel 22 is decreased) and introducing a liquid volume from the upstream reservoir (not illustrated) into the pumping device 40.

Step (c): also the second pair of working chambers 23*c*, 23*d* are released, thus opening the transport channel 22 and allowing more liquid to enter the pumping device 40.

Step (d): the first pair of working chambers 23*a*, 23*b* are now actuated again, thus closing the first part of the transport channel (increase of flow resistance) and enclosing the fluid in the middle part of the transport channel 22.

Step (e): the third pair of working chambers 23*e*, 23*f* are being released, thus opening the third part of the transport channel 22 to facilitate transport of the fluid in 23*c*/*d* (next step).

Step (f): the second pair of working chambers 23*c*, 23*d* are now being actuated, thus closing the middle part of the transport channel 22, so that the fluid volume which was present at the middle part of the transport channel 22 is pushed downstream so as to be present in the transport channel at the location between the third pair of working chambers 23*i*, 23*f*.

Step (a): the third pair of working chambers 23*e*, 23*f* are being actuated, thereby pushing the fluid volume into the downstream reservoir, and closing the channel 22 by the three pairs of working chambers 23*a*, 23*b*; 23*c*, 23*d*; 23*e*, 23*f*. The pumping device 40 is ready for a next transport of a volume of transport fluid.

Besides the above-presented motion, there are numerous other possible actuation schemes. The number of ways to actuate a micropump increases with the number of components (valves) which vary the transport channel cross-section.

Figure 7:
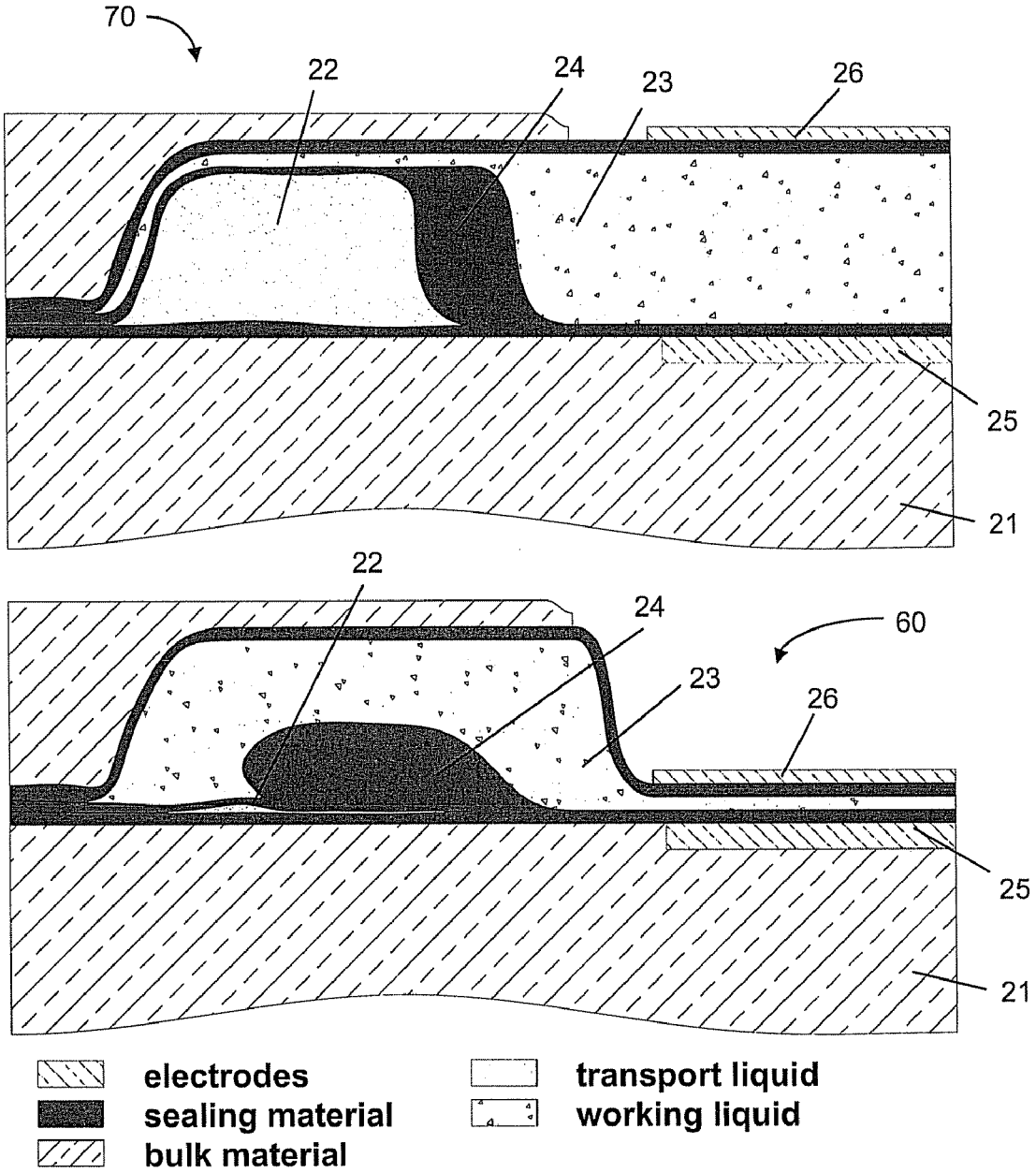
FIG. 7 is a cross-sectional view of a microfluidic device in accordance with an embodiment, in non-actuated state (top part of the drawing) and in actuated state (bottom part of the drawing)

An alternative embodiment of a microfluidic device 70 is illustrated in FIG. 7. In this embodiment, a transport channel 22 is provided inside a working chamber 23, the transport channel 22 and the working chamber 23 being separated from each other by means of a flexible wall 24. The transport channel 22 and the working chamber 23 may have one or more walls in common. In embodiments of the present invention, as also illustrated in FIG. 7, the majority of the working chamber 23 is provided at one side of the transport channel 22. A flexible, deformable wall 24 is provided in between the working chamber 23 and the transport channel 22. The transport channel 22 is filled with transport fluid, and the working chamber 23 is filled with working fluid. At opposite sides of the working chamber 23, away from the transport channel 22, i.e. on a part of the wall of the working chamber 23 which is not in contact with the transport channel 22, neither in non-actuated state nor in actuated state, a first electrode 25 and a second electrode 26, respectively, are provided. In the embodiment illustrated, the first and second electrodes 25, 26 are provided at the top and the bottom side of the working chamber 23, respectively.

The top part of FIG. 7 illustrates a non-actuated microfluidic device 70, i.e. where the electrodes 25, 26 are not driven so as to deform the working chamber 23 and hence the flexible wall 24 between the working chamber 23 and the transport channel 22. The bottom part of FIG. 7 illustrates an actuated microfluidic device 70, i.e. where the electrodes 25, 26 are driven so as to deform the working chamber 23 and the transport channel 22. In both cases, only a small cross-section around the transport channel 22 is shown. In the embodiment illustrated, in the actuated state the transport channel 22 is substantially, and preferably completely closed. By actuating the electrodes 25, 26, working fluid present inside the working chamber 23 is pushed towards the deformable wall 24 between the working chamber 23 and the transport channel 22. This causes the deformable wall 24 to deform, thus causing the transport channel 22 to collapse under pressure of the moving working fluid. Part of the electrostatic energy is converted into and stored as elastic energy of the flexible wall, made of flexible material also called sealing material, of the transport channel 22. Looking at the cross-section, the displaced working fluid temporarily restrains the transport fluid from flowing. The degree of closure of the transport channel 22 (or in other words the degree of collapsing of the transport channel 22) is determined by the pressure on the transport channel 22 applied by the displaced working fluid. This pressure on the transport channel 22 is determined by the degree of deformation of the working chamber 23, and this in turn is determined by the actuation of the first and second electrodes 25, 26. The elastic energy of the flexible wall of the transport channel 22 and the additional force from the transport fluid pressure—which is being generated by the input flow or by a preceding valve or preceding set of valves—is being released when the actuator restores to the original configuration.

FIG. 7 also indicates the different types of materials that may be needed according to their function.

Figure 8:
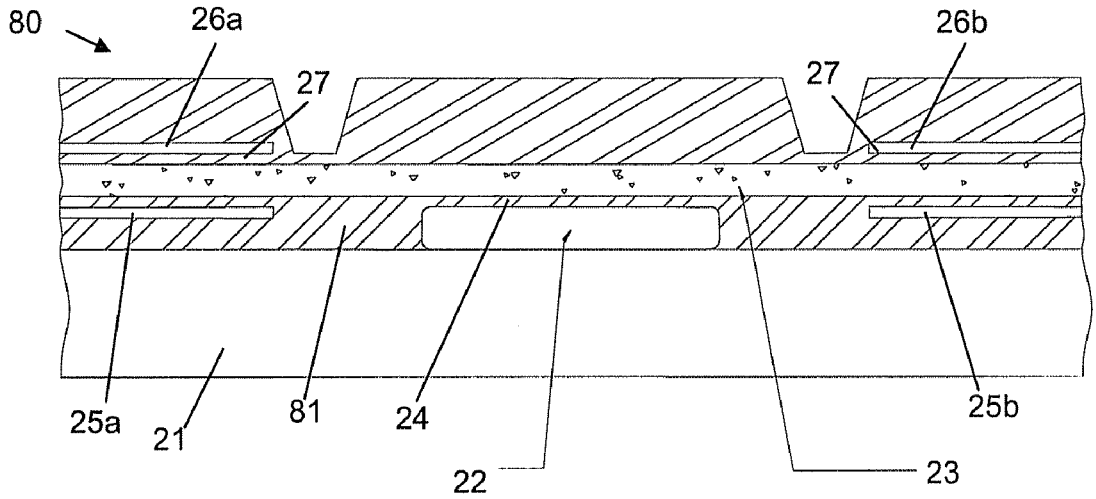
FIG. 8 and FIG. 9 illustrate a device according to an embodiment, in non-actuated and actuated state, respectively.

A microfluidic pumping device 80 according to yet another alternative embodiment is illustrated in FIG. 8. In this embodiment, stacked layers are provided, where the working fluid layer is on top of the transport fluid layer. Again, the electric field applied to the working fluid does not influence the transport fluid. From a fabrication point of view, this embodiment shows an advantage, with respect to embodiments where the deformable wall between the working chamber and the transport channel is vertical.

FIG. 8 shows a cross-section of the microfluidic device 80, in a transversal direction of the transport channel 22. Contrary to the previous embodiment, the working chamber is not provided next to the transport channel 22, but on top thereof. In an alternative embodiment (not illustrated), the transport channel 22 could be on top of the working chamber 23. A common deformable wall 24 is present between the transport channel 22 and the working chamber 23.

The transport channel 22 is suitable for containing a transport fluid, e.g. a first liquid such as e.g. ethanol, water or any other suitable fluid, preferably a low-viscosity fluid. The working chamber 23 is suitable for containing a working fluid, e.g. a second liquid such as e.g. purified water. Due to the deformable wall 24 between the transport channel 22 and the working chamber 23, there is no direct contact between the working fluid and the transport fluid.

The microfluidic device 80 comprises means for increasing the pressure on the working fluid in the working chamber 23 such that, when the working fluid is put under pressure, the deformable wall 24 between the working chamber 23 and the transport channel 22 deforms, resulting in a change in the cross-section of the transport channel 22 (for example, resulting in a reduction in cross-section of the transport channel 22). In other words, in embodiments of the present invention, upon increasing the pressure on the working fluid in the working chamber 23, the transport channel 22 is squeezed, and at least partially closed or optionally completely closed or substantially completely closed. The means for increasing the pressure on the working fluid in this embodiment comprise a first set of first and second electrodes 25*a*, 26*a* and a second set of first and second electrodes 25*b*, 26*b*. The first and second sets of electrodes are located at opposite sides, in transversal direction, of the transport channel 22. With respect to the working chamber 23, the electrodes of a set are located at opposite sides of the working chamber 23. The first and second electrodes 25*a*, 25*b*, 26*a*, 26*b* are plate electrodes. They may be made from any suitable conductive material, e.g. they may be metal electrodes. The electrodes may for example comprise a material selected from the group consisting of gold, aluminium, platinum, chrome, titanium, doped poly-silicon. They may comprise a sandwich of layers of conductive materials (e.g. a Cr/Al/Cr sandwich) or could be made out of highly conductive polymers.

They may have an arbitrary shape; however, preferably, for the sake of optimal forces the electrodes of a set may be of identical shape and aligned one on top of each other. They may for example have a rectangular shape, a square shape, a circular shape, or any other suitable shape. The electrodes 25*a*, 26*a*; 25*b*, 26*b* of a set are located against opposite sidewalls of the working chamber 23, away from the transport channel 22. With "away from the transport channel 22" is meant that the sets of first and second electrodes 25*a*, 26*a*; 25*b*, 26*b* do not directly contact any of the sidewalls of the transport channel 22.

In the embodiment illustrated in FIG. 8, the first electrodes 25*a*, 25*b* are provided on or in an intermediate layer 81, which comprises the transport channel 22. The top wall 27 of the working chamber 23, at least at the locations where the second electrodes 26*a*, 26*b* are present, is formed by a flexible or elastic material such as e.g. polyimide, parylene, SU-8, PDMS or BCB (benzocyclobutene). The deformable wall 24 between the working chamber 23 and the transport channel 22 and the flexible top wall 27 of the working chamber 23 may be made, but do not need to be made, out of different materials. They may have, but do not need to have, different properties. For example, they may have different flexibility. The working chamber 23 has at least one flexible wall, apart from the deformable wall 24. At least one of the electrodes 25*a*, 26*a*; 25*b*, 26*b* of the electrode sets is provided against the flexible wall 27. Due to the provision of one of the electrodes 25*a*, 26*a*; 25*b*, 26*b* against a flexible wall 27, this electrode 26*a*, 26*b* can move in the direction to and from the other electrode 25*a*, 25*b* of a same set, e.g. up and down, depending on the actuation state (on/off). In the embodiment illustrated, the second electrodes 26*a*, 26*b* are provided against the flexible top wall 27 of the working chamber 23. In other embodiments (not illustrated), one of the electrodes can be mounted against a flexible bottom wall of the microfluidic device 80. In yet other embodiments (not illustrated), both first electrodes 25*a*, 25*b* and second electrodes 26*a*, 26*b* can be mounted against flexible walls, e.g. against a flexible bottom wall and a flexible top wall, respectively, or against two opposite sidewalls (not illustrated).

Providing actuation electrodes 25*a*, 26*a*; 25*b*, 26*b* at either side of the working chamber 23 rather than at either side of the transport channel 22 has the advantage that no electrical fields are applied to the transport fluid in the transport channel 22. This can be beneficial to avoid electrolysis of the fluidic contents of the transport channel. This may also be advantageous in avoiding the negative effects of imposing an electrical field upon contents of the transport channel 22 that are sensitive to such an applied field, for example cells or electrically polar tags or solvents.

Providing actuation electrodes 25*a*, 26*a*; 25*b*, 26*b* of a set at either side of a working chamber 23 away from the transport channel 22 furthermore has the advantage that the electric field between the actuation electrodes 25*a*, 26*a*; 25*b*, 26*b* is independent of the transport fluid permittivity and the transport wall material permittivity, but depends on the working fluid and its properties (e.g. permittivity). In embodiments of the present invention, the transport fluid permittivity does not influence the performance of the microfluidic device. The working fluid is being confined within a closed volume, the working chamber 23, such that when a force is being applied on the side(s) of this volume, the structure changes shape due to the working fluid incompressibility.

Providing sets of actuation electrodes 25*a*, 26*a*; 25*b*, 26*b* at either side of a working chamber 23 away from the transport channel 22 has the further advantage that larger working chambers 23 and hence larger actuation electrodes 25*a*, 25*b*, 26*a*, 26*b* can be used. Therefore, the actuation force, which is restricted by the electrode plate area, is no longer constrained by the channel width in accordance with embodiments of the present invention, but can be varied according to various requirements. Hence larger actuation forces can be applied to the transport channel wall 24.

Figure 9:
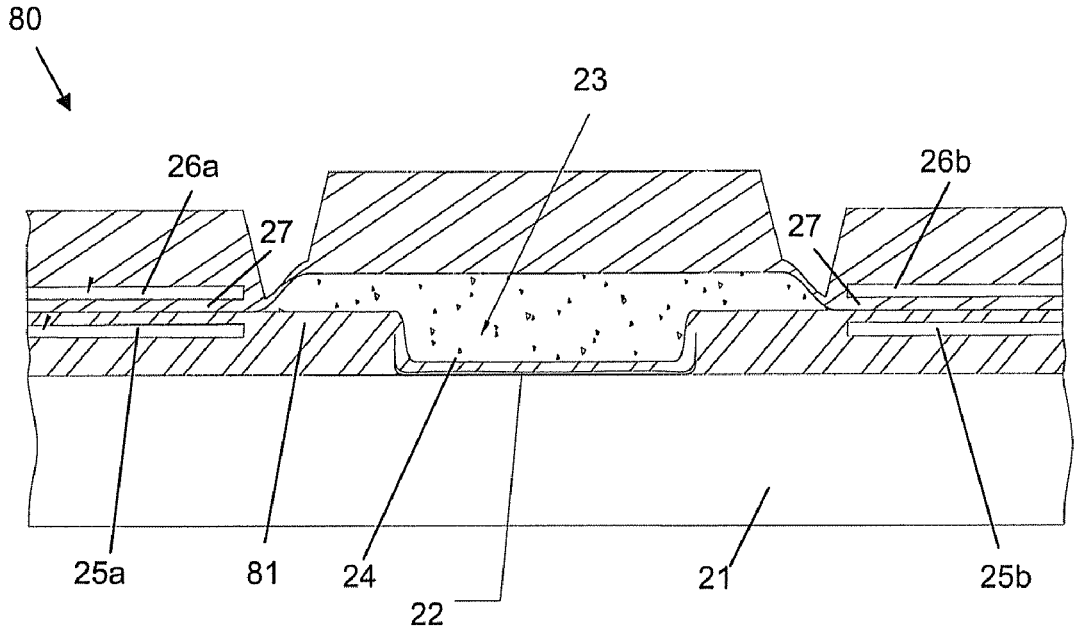

FIG. 8 shows the microfluidic device 80 in non-actuated state, i.e. where the transport channel 22 is open and thus in a transport state allowing transport fluid to pass through. FIG. 9 illustrates another state of the same microfluidic device 80, namely an actuated state. Upon a sufficiently large electrical field being applied to the sets of first and second electrodes 25*a*, 26*a*; 25*b*, 26*b*, the electrodes in each actuated set move towards each other, thus deforming the working chamber 23, in particular e.g. in the embodiment illustrated reducing the volume of the working chamber 23. Under pressure of the working fluid in the working chamber 23, which is displaced by the force applied by the sets of first and second electrodes 25*a*, 26*a*; 25*b*, 26*b*, the deformable wall 24 between the working chamber 23 and the transport channel 22 is deformed, thus changing the cross-section of the transport channel 22. The change in cross-section in this embodiment is a reduction in the cross-section. The reduction in cross-section may be so as to at least partly, and optionally completely or substantially completely, close the transport channel 22. In a completely closed state or substantially completely closed state, substantially no transport fluid can pass through the transport channel 22, and preferably no transport fluid at all can pass through.

Figure 10:
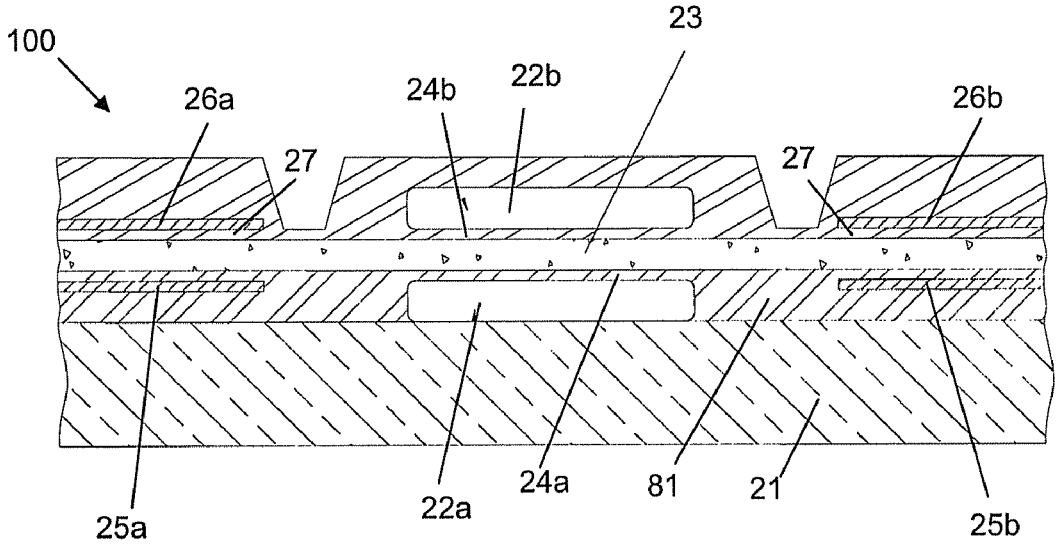
FIG. 10 and FIG. 11 illustrate a device according to an embodiment, in non-actuated and actuated state, respectively.
Figure 11:
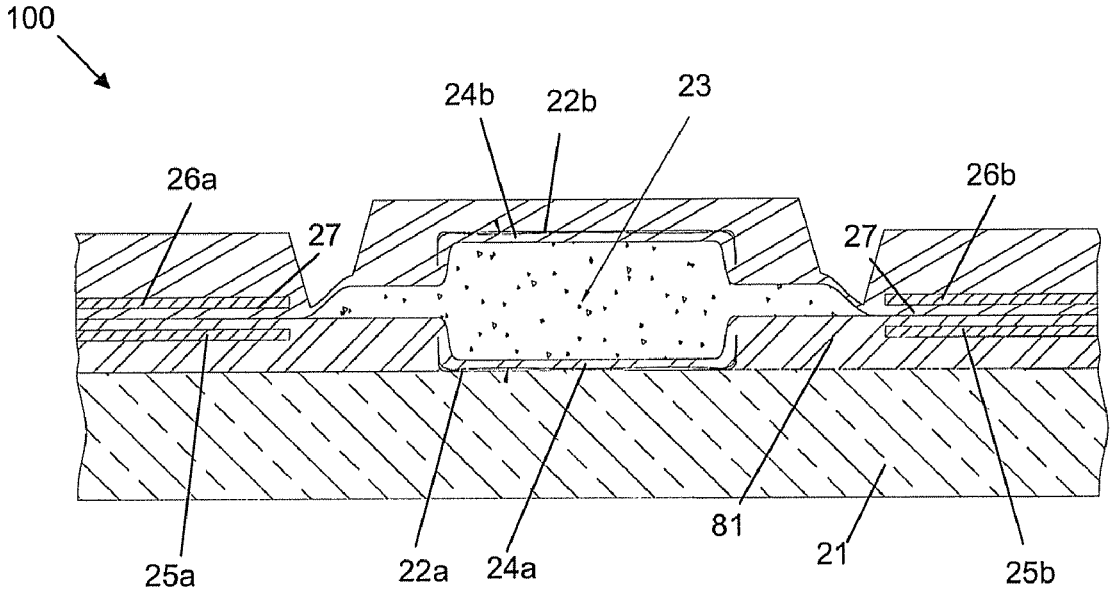

FIGS. 10 and 11 illustrate yet another embodiment of a microfluidic device 100. In this embodiment, two transport channels 22*a*, 22*b* are provided at either side of the working chamber 23. A deformable wall 24*a*, 24*b*, respectively, is present between the first transport channel 22*a* and the working chamber 23, and between the second transport channel 22*b* and the working chamber 23. In this embodiment, more than one channel 22*a*, 22*b* may be opened or closed at the same time, with a potential to accurately mix fluids from the two channels (at their output or elsewhere on a microfluidic chip) in substantially equal quantities. Thus, with one actuation signal, both transport channels 22*a*, 22*b* may be reduced in cross-section This embodiment is explained in less detail than the previous ones; however, same reference numbers refer to analogous details of the device. The principle behind the device 100 according to this embodiment is again that actuation of (sets of) electrodes 25*a*, 25*b*; 26*a*, 26*b* deforms a working chamber 23. The deformation of the working chamber 23 causes a deformation of the transport channels 22*a*, 22*b*. No electrodes are provided against the walls of the transport channels 22*a*, 22*b*, and hence no electrical fields are applied to the transport liquid in the transport channels 22*a*, 22*b*.

FIG. 10 shows the microfluidic device 100 in non-actuated state, e.g. channels 22*a*, 22*b* being open. FIG. 11 shows the same device 100 in actuated state. Upon a sufficiently large electrical field being applied to the sets of first and second electrodes 25*a*, 26*a*; 25*b*, 26*b*, the electrodes in each actuated set move towards each other, thus deforming the working chamber 23, in particular e.g. in the embodiment illustrated reducing the volume of the working chamber 23. Under pressure of the working fluid in the working chamber 23, which is displaced by the force applied by the sets of first and second electrodes 25*a*, 26*a*; 25*b*, 26*b*, the deformable walls 24*a*, 24*b* between the working chamber 23 and the transport channels 22*a*, 22*b* are deformed, thus changing the cross-sections of the transport channels 22*a*, 22*b*. The changes in cross-sections in this embodiment are reductions in the cross-sections. The reductions in cross-section may be so as to at least partly, and optionally completely or substantially completely, close the transport channels 22*a*, 22*b*. In a completely closed state or substantially completely state, substantially no transport fluid can pass through the transport channels 22*a*, 22*b*, and preferably no transport fluid at all can pass.

In the above embodiments of the present invention, electrostatic actuation has been shown to present advantages over other actuation methods such as expansion based on heating. In alternative embodiments of the present invention, also piezoelectric actuation may be used in some applications. The bio-compatibility of certain piezoelectric materials can be improved by encapsulating the respective materials in between suitable materials, such as for example inert polyimide layers.

The working principle of the valves is similar or identical to the one described in other embodiments, e.g. with respect to FIG. 8 and FIG. 9. The main difference lies in the way how pressure is changed in the working fluid. Whereas in the previous embodiments disclosed, the pressure change was a result of an electrostatic force between one or more pairs of electrodes, in the present embodiment the pressure difference arises from piezoelectric actuation, changing the geometry of one or more piezoelectric actuators.

Figure 12:
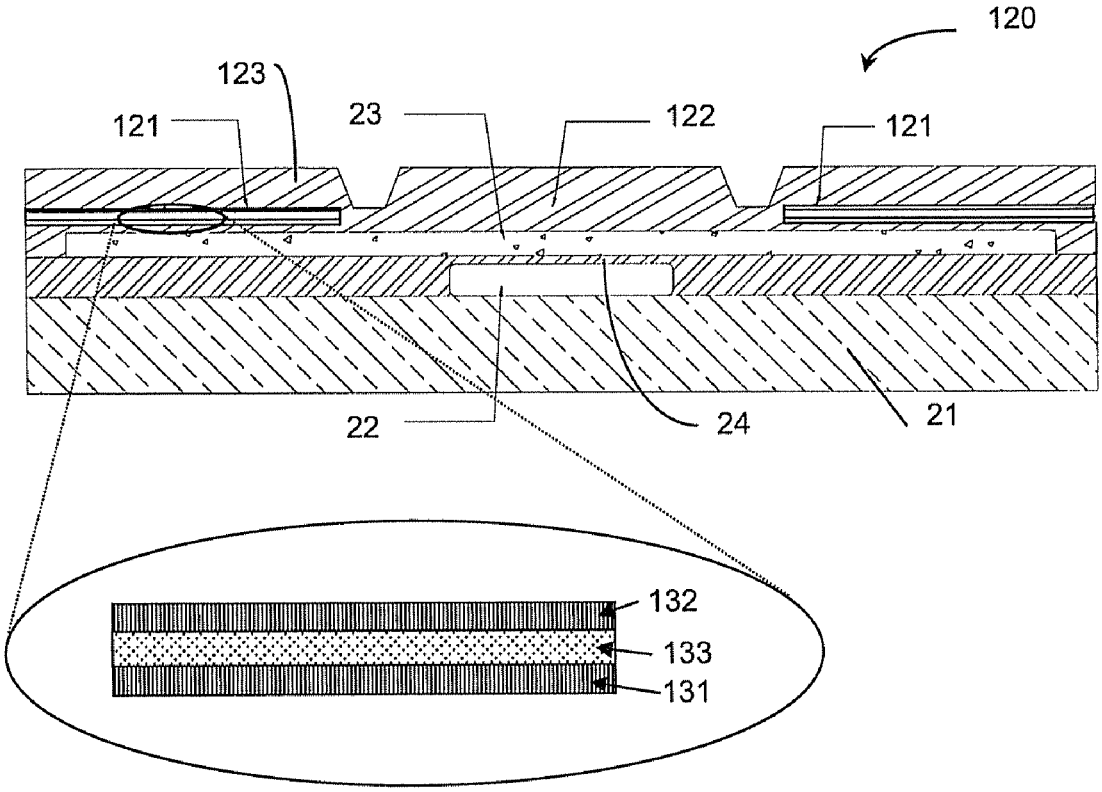
FIG. 12 is a cross-sectional view of a piezo-actuatable microfluidic device in accordance with an embodiment, in non-actuated state.

FIG. 12 schematically illustrates a piezo-actuated microfluidic valve according to embodiments of the present invention.

A microfluidic device 120 is provided. The microfluidic device 120 comprises a substrate 21, a transport channel 22 and a working chamber 23 separated from each other by a common deformable wall 24. In embodiments of the present invention, the term "substrate" may include any underlying material or materials that may be used, or upon which a device may be formed. In other alternative embodiments, this "substrate" may include a semiconductor substrate such as e.g. silicon, a gallium arsenide (GaAs), a gallium arsenide phosphide (GaAsP), an indium phosphide (InP), a germanium (Ge), or a silicon germanium (SiGe) substrate. The "substrate" may include for example an insulating layer such as a $SiO_2$ or a $Si_3N_4$ layer in addition to a semiconductor substrate portion. Thus, the term substrate also includes silicon-on-glass, silicon-on sapphire substrates. The term "substrate" is thus used to define generally the elements for layers that underlie a layer or portions of interest, in particular a microfluidic device 120. Also, the "substrate" may be any other base on which a microfluidic device is formed (for example a glass, quartz, fused silica or metal foil). A flexible and optionally even a transparent system can be achieved by having suitable polymers as bulk and structural materials.

The transport channel 22 may be suitable for containing a transport fluid, e.g. a first liquid such as e.g. ethanol, water or any other suitable fluid (for example a low-viscosity fluid). The working chamber 23 may be suitable for containing a working fluid, e.g. a second liquid such as e.g. purified water. Due to the deformable wall 24 between the transport channel 22 and the working chamber 23, there is no direct contact between the working fluid and the transport fluid.

The microfluidic device 120 comprises means for increasing the pressure on the working fluid in the working chamber 23 such that, when the working fluid is put under pressure, the deformable wall 24 between the working chamber 23 and the transport channel 22 deforms, resulting in a change in the cross-section of the transport channel 22, for example resulting in a reduction in cross-section of the transport channel 22. In other words, in embodiments of the present invention, upon increasing the pressure on the working fluid in the working chamber 23, the transport channel 22 is squeezed, and at least partially closed, optionally completely closed or substantially completely closed. The means for increasing the pressure on the working fluid comprises one or more piezoelectric actuators 121, located at a sidewall of the working chamber 23. The one or more piezoelectric actuators 121 may each comprise one or more piezoelectric layers 133 in between a first piezoelectric electrode 131 and a second piezoelectric electrode 132 (as schematically illustrated in FIG. 12). In alternative embodiments the one or more piezoelectric actuators 121 may each comprise one or more piezoelectric layers, a first piezoelectric electrode and a second piezoelectric electrode wherein the first piezoelectric electrode and the second piezoelectric electrode are interdigitated electrodes positioned at a same side of the one or more piezoelectric layers (not illustrated).

The piezoelectric layers 133 may comprise any suitable piezoelectric material, e.g. they may comprise natural piezoelectric materials such as for example layers of tourmaline, quartz, topaz, man-made piezoelectric materials such as for example gallium orthophosphate, langasite, or piezoelectric polymers such as for example polyfluoretheen, polyvinyliden fluoride or PVDF, or piezoelectric ceramics such as for example barium titanate ($BaTiO_3$), lead titanate ($PbTiO_3$), lead zirconate titanate or PZT ($Pb[Zr_xTi_{1-x}]\ O_3\ 0<x<1$), potassium niobate ($KNbO_3$), lithium niobate ($LiNbO_3$), lithium tantalite ($LiTaO_3$), sodium tungstate ($Na_2WO_3$). The at least one piezoelectric actuator 121 may comprise a sandwich of layers 133 of piezoelectric materials. The bio-compatibility of some of the piezoelectric materials can be improved by encapsulating the respective materials in between suitable biocompatible materials, such as for example inert polyimide layers. The piezoelectric electrodes 131, 132 of the at least one piezoelectric actuator 121 may have an arbitrary suitable shape. The electrodes of the at least one piezoelectric actuator may for example have a rectangular shape, a square shape, a circular shape, or any other suitable shape. The one or more piezoelectric actuators 121 with electrodes 131, 132 are located against sidewalls of the working chamber 23, in direct or indirect physical contact therewith, away from the transport channel 22. With "away from the transport channel 22" is meant that the actuators 121 do not directly contact any of the sidewalls of the transport channel 22.

FIG. 12 shows the situation at rest, when the at least one piezoelectricactuator 121 is not activated. The working chamber 23 is not deformed, and hence the working fluid in the working chamber 23 is not put under pressure. The transport channel 22 is open, so that transport fluid may pass the valve.

Figure 13:
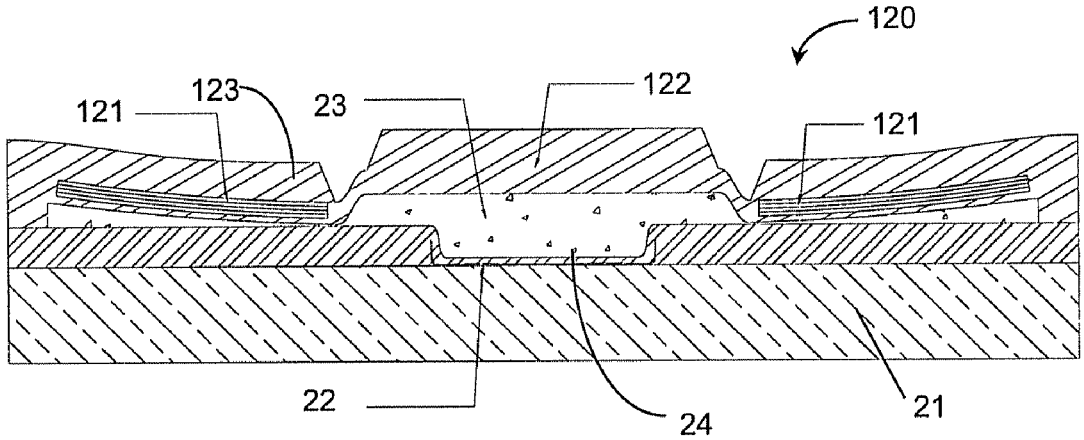
FIG. 13 is a cross-sectional view of the microfluidic device of FIG. 12, in actuated state whereby piezoelectric actuation creates over-pressure in the working fluid.

When actuation of the at least one piezoelectric actuator 121 takes place, i.e. when a voltage is applied between the first piezoelectric electrode 131 and the second piezoelectric electrode 132 of the at least one piezoelectric actuator 121, the shape of the at least one piezoelectric layer 133 and thus the shape of the piezoelectric actuator 121 changes. The bending stress resulting from the actuation leads to concave bending of the piezoelectric actuator(s) 121 and deformation of the working chamber 23, hereby increasing the fluid pressure (FIG. 13). The deformable wall 24 between the working fluid in the working chamber 23 and the transport fluid in the transport chamber 22 is actuated by the piezoelectric actuator(s) 121 which bend downwards and squeeze(s) the transport channel 22, thus at least partly closing it.

Depending on the specific structure, a pressure compensator 122 may be used to improve performance. For instance, in FIG. 13, when the transport channel 22 is fully closed but the actuation increases beyond this point, the pressure compensator 122 may bend upwardly under influence of the pressure built up in the working chamber 23 in order to keep the working fluid pressure within limits and to avoid damage such as leakage or delamination of the biocompatible layers on the piezoelectric actuators 121.

Depending on the fabrication, the one or more piezoelectric actuators 121 may come in contact with the environment, which could be undesirable for biocompatibility. In this case, a top layer 123 of biocompatible material (e.g. a polyimide layer) can be used to prevent interaction with the ambient. FIGS. 12 to 15 show such a top layer 123 which includes the pressure compensator 122 and intrusions 124 to contact the piezoelectric actuators 121. For the sake of biocompatibility, such intrusions can be avoided in the final product.

Figure 14:
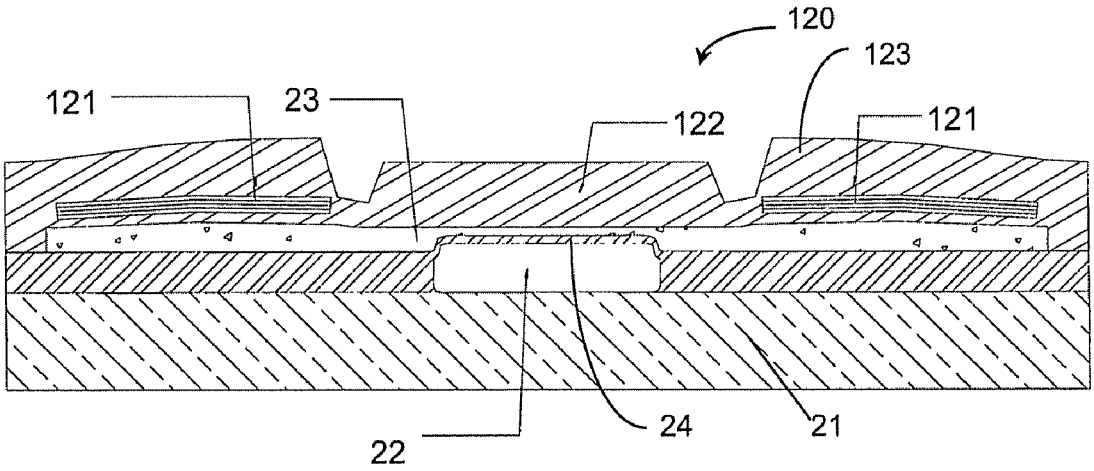
FIG. 14 is a cross-sectional view of the microfluidic device of FIG. 12, in actuated state whereby piezoelectric actuation creates under-pressure in the working fluid.

Piezoelectric actuators are preferably operated in flexural mode; one end clamped and the other end flexible for achieving maximum displacement, as illustrated in FIGS. 12 to 14 where the outer ends of the piezoelectric actuators 121, i.e. the ends away from the transport channel 22 are clamped. However, for some applications, and in particular the applications that require high precision dosing, a doubly clamped structure or a piezoelectric membrane clamped on all edges can be used. Additionally, as illustrated in FIG. 15, a plate 125, which is attached to several piezoelectric actuator beams 121, can be used for applying supplementary pressure on the working fluid chamber 23.

Figure 15:
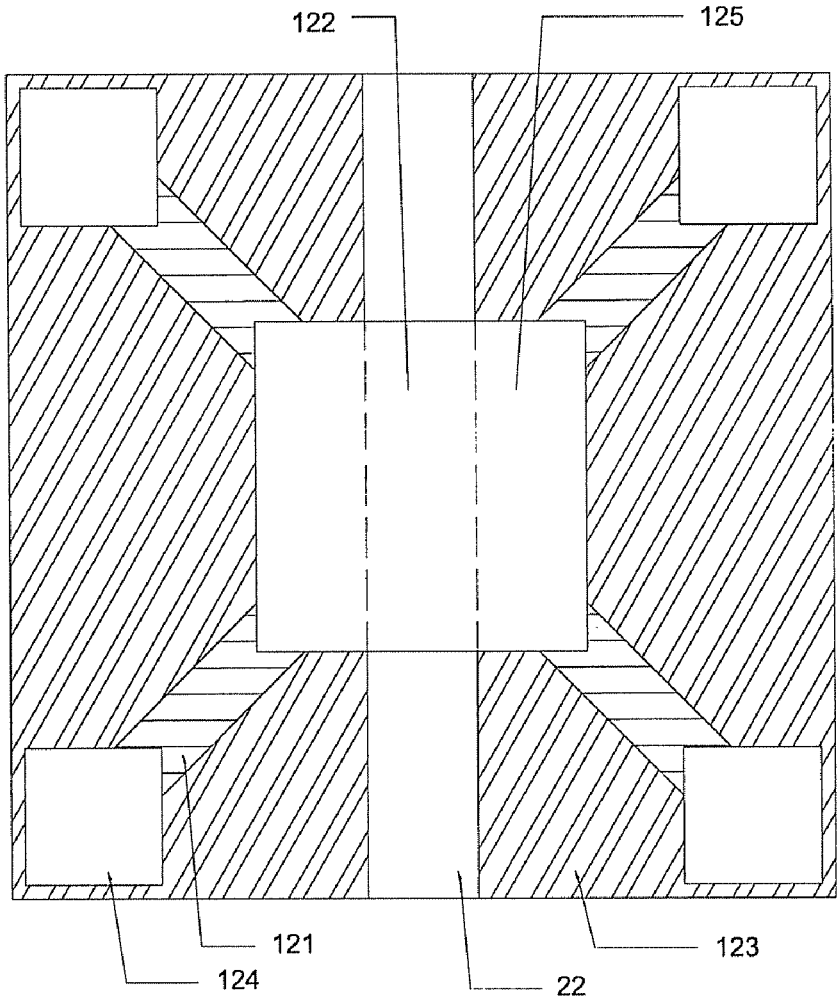
FIG. 15 is a top view of one piezo-actuatable valve according to embodiments, comprising four piezoelectric electrodes.

In FIG. 15, all piezoelectric actuators 121 may bend together or separately up and/or down, in order to regulate the pressure in the working fluid in the working chamber 23 and thus also to regulate the fluid flow in the transport channel 22. When for instance first actuating the two actuators 121 illustrated at the bottom of FIG. 15, and thereafter the two actuators 121 illustrated at the top of FIG. 15, the flow direction (upwards in the figure) is already dictated by each valve independently.

The piezoelectric embodiments according to embodiments of the present invention present certain advantages with respect to the already existing prior art solutions, and the other embodiments presented in this document.

An advantage of piezoelectric actuation according to embodiments of the present invention compared to electrostatic actuation according to other embodiments of the present invention is that the actuation direction can be inversed, so that the piezoelectric actuators 121 bend in a convex way, as illustrated in FIG. 14. The pressure in the working fluid decreases, and the deformable wall 24 between transport channel 22 and working chamber 23 deflects upwardly, depending on the pressure in the transport channel 22. This increases the transport channel section area and thus the throughput.

The pressure compensator 122 avoids extremely low working fluid pressures, which may give rise to vacuum bubbles in the working fluid. Moreover, it protects the flexible wall 24 against damage due to too high a pressure difference between the transport channel 22 and the working chamber 23.

Furthermore, there are no strong limitations on dimensions of working chamber 23 and transport channel 22: unlike with the electrostatic principle, where the actuator force depends strongly on the distance between the electrostatic electrodes and thus the height of the working chamber 23, the piezoelectric actuator performance is not directly influenced by the height of the working chamber 23.

Due to the piezoelectric actuation principle, the piezoelectric embodiments of the present invention may have low power consumption. Piezoelectric actuation typically requires lower voltages as compared to electrostatic actuation. In case of piezoelectric actuation, the actuation voltage may range from 100 mV to several volts (e.g. 5 to 10 V) or tens of Volts, depending on device dimensions, required displacement, the piezoelectric material used, its piezoelectric constants and its breakdown voltage. In case of electrostatic actuation the actuation voltage is typically in the order of tens of Volts. Additionally, piezoelectric materials are good dielectrics, which means that losses due to dielectric leakage may be low.

With piezoelectric embodiments of the present invention, very accurate dosing may be obtained if so required: unlike the electrostatic principle, no dynamic instability (between the energy buffers 'spring' and 'variable plate capacitor') is present. The relation between the increase of actuation voltage and pressure change is therefore about linear, which allows accurate dosing. The accurate dosing may even be below the volume of one valve.

A further advantage is the reduced actuation voltage: the actuator deflection can be kept at a minimum, because the length and width of the at least one piezoelectric actuator can be chosen as large as necessary during design and fabrication.

The piezoelectric actuation takes place away from the transport channel 22, and thus has no direct influence on it.

As illustrated above, bi-directional actuation of the one or more piezoelectric actuators may be possible (FIG. 13 and FIG. 14) in two ways: by changing the voltage polarity of the piezoelectric actuator or by providing a symmetric piezoelectric layer structure, such that bending in both directions becomes possible only with one polarity (either positive or negative). The second alternative, comprising providing a symmetric piezoelectric layer structure, requires more than two electrodes and possibly more than one piezoelectric layer. This symmetric layer structure can also be used for compensating process induced residual stresses that can influence the device performance.

In embodiments of the present invention, a piezoelectric sensor can be used for measuring the pressure level inside the transport channel. Pressure induced strain in a piezoelectric layer or stack of layers creates an electrical signal that can be detected with proper circuitry. This can be useful in applications that require precise monitoring (e.g. in vivo implants for drug delivery) or applications that involve phase change reactions in the working fluid.

For fabricating piezoelectrically actuated micropump devices 120 according to embodiments of the present invention, a two wafer approach can be used, wherein the piezoelectric actuators and the microfluidic part are fabricated on different wafers (see below). In embodiments of the present invention this improves the fabrication of the polymeric transport section by means of removing the active device components fabrication, i.e. electrodes and contacts, from polymer processes. Furthermore, the two wafer approach brings flexibility in the piezoelectric actuator design, which can be in various geometries for improving pressure transduction.

It is an advantage of fabricating the actuator and the microfluidic system separately that any kind of piezoelectric materials can be used in the process. Some piezoelectric materials suitable for this purpose are AlN, ZnO, PZT ($PbZr_xTi_{1-x}O_3$, where $0<x<1$), solid solutions of various perovskite piezoelectrics such as $BaTiO_3$ and $KTaO_3$ and $KNbO_3$, organic piezoelectric materials such as PVDF and PVC. The piezo electrode may comprise a piezoelectric layer and two contact electrodes that are used for actuation. Electrode materials for the contact electrodes can be metals such as for example Pt, Mo, Al, Ir, Cu, W; nitrides as for example TiN and TaN, silicides as for example NiSi, WSi; oxides as for example $SrRuO_3$, $RuO_3$, $IrO_2$, and organic, polymeric conductors.

The geometry and lateral dimensions of the piezoelectric actuators 121 can be selected as desired by the dimensions of the microfluidic channel 22. The typical thickness of the individual components of the piezoelectric stack (i.e. piezoelectric electrodes 131, 132 and piezoelectric layer 133) can range from several tens of nanometers to several microns. Increasing the piezoelectric electrode thickness also increases the stiffness of the piezoelectric actuator 121 and therefore is not advantageous for high displacement, when the minimum thickness fulfills the structural rigidity requirements.

Figure 16:
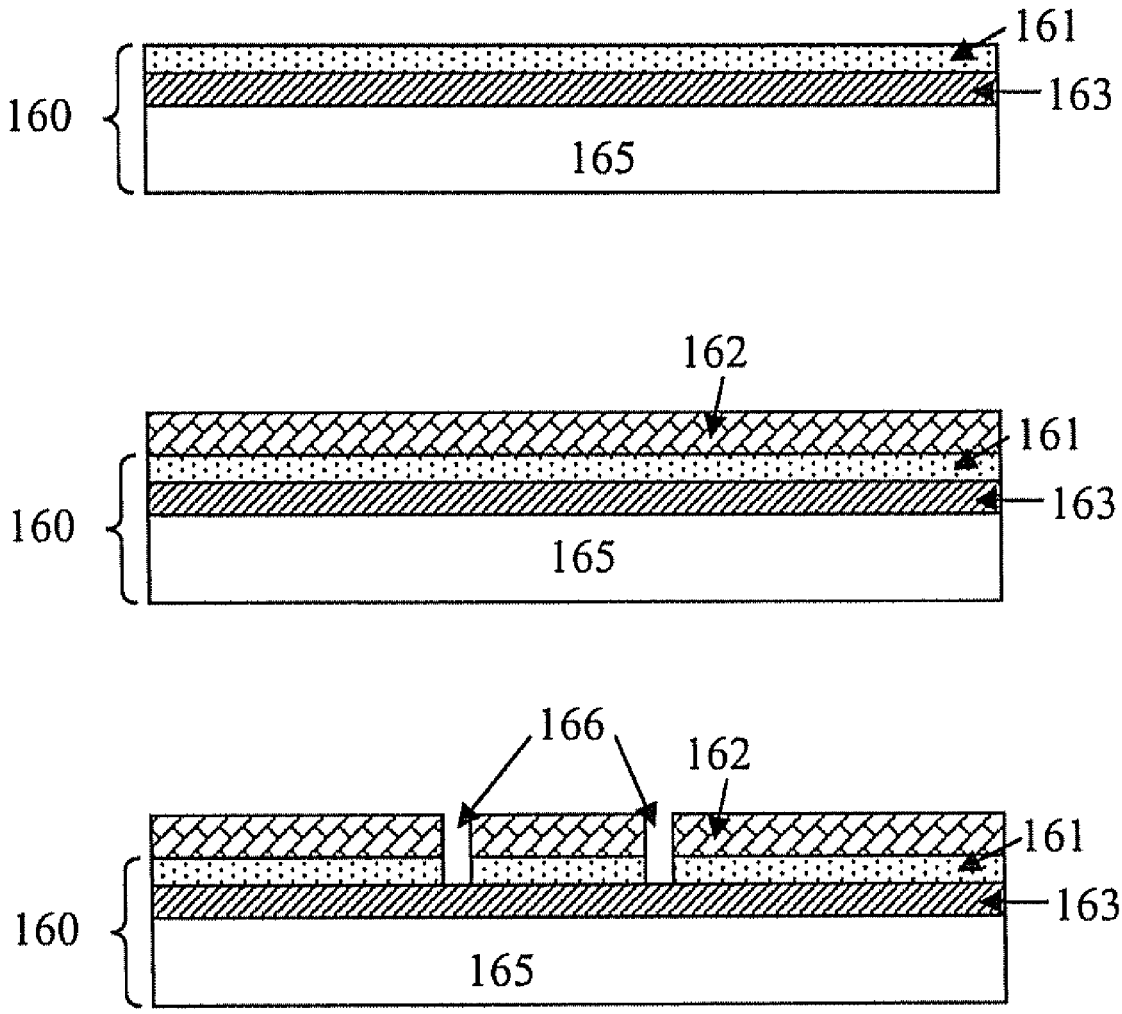
FIG. 16 illustrates a fabrication work flow for fabrication of piezoelectric devices on an SOI wafer according to embodiments.
Figure 17:
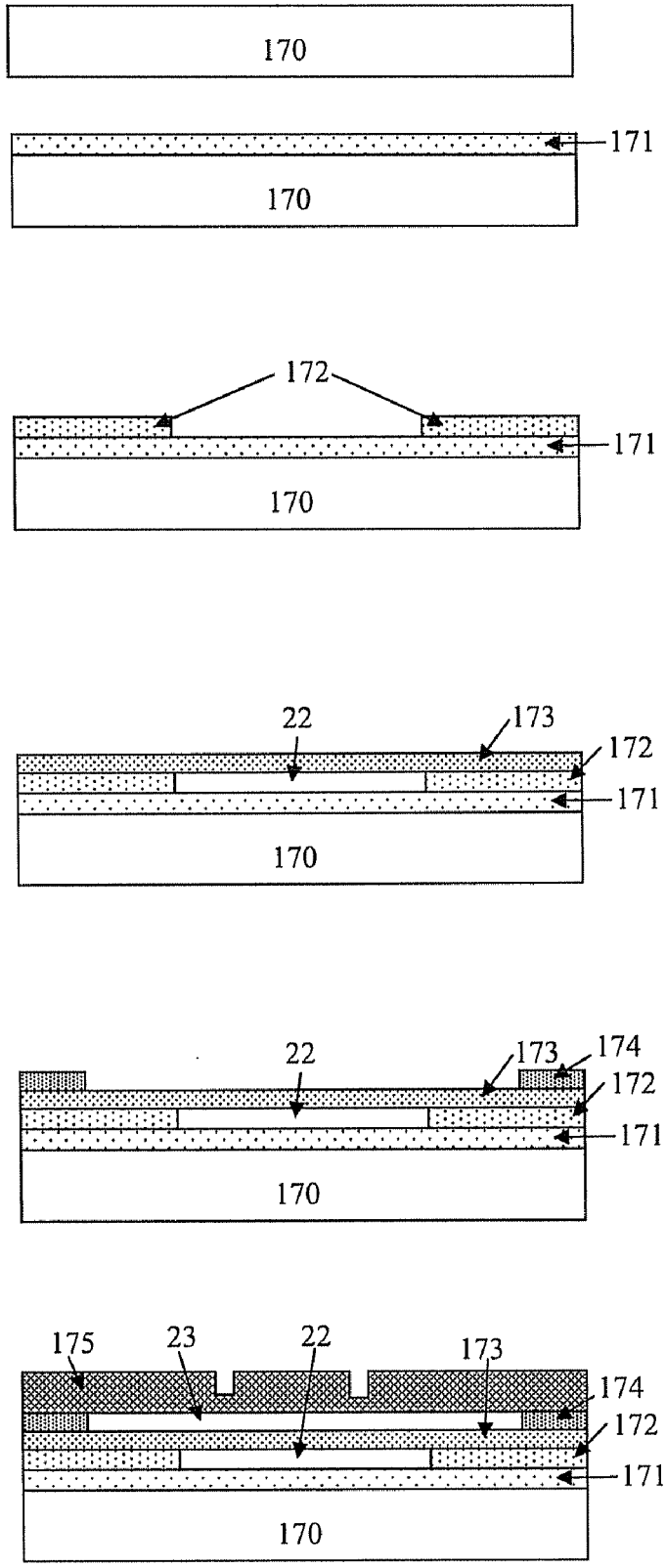
FIG. 17 illustrates a fabrication work flow for fabrication of microfluidic channels according to embodiments.

A possible fabrication method of a piezoelectric device according to embodiments of the present invention is illustrated by means of the process flows of FIGS. 16 to 18, can be described as follows:

1. Fabrication of the Piezoelectric Devices (Piezoelectric Wafer)—FIG. 16.

A suitable substrate may be obtained. In particular embodiments, such suitable substrate may be a SOI (silicon on insulator) wafer 160 comprising a handling layer 165, an intermediate silicon oxide layer 163 and a functional silicon layer 161, as illustrated in FIG. 16, or more in general a wafer with a sacrificial layer 165 and an appropriate etch stop layer 163 deposited on top of it. In both cases, the thickness of the top layer 161 can be selected depending on the mechanical requirements of the piezoelectric device, e.g. the device stiffness.

The piezoelectric stack 162 comprising a first piezoelectric electrode, at least one piezoelectric layer and a second piezoelectric electrode is deposited. This may be done by (not illustrated in detail in FIG. 16): depositing a first piezoelectric electrode layer (optionally including patterning this first layer of electrode material); depositing at least one piezoelectric layer; optionally including patterning the at least one piezoelectric layer; and depositing a second piezoelectric electrode layer (optionally including patterning this second layer of electrode material).

In alternative embodiments, the different layers (first piezoelectric electrode layer, piezoelectric layer, second piezoelectric electrode layer) may be deposited one on top of the other, and the method may furthermore include sequentially top down patterning of all layers applied.

The piezoelectric actuators may be pre-released by creating trenches 166 through the piezoelectric stack 162.

2. Fabrication of the Microfluidic Channels (Microfluidic Wafer)—FIG. 17.

First, a suitable substrate 170 is provided.

A transport channel 22 is manufactured in any suitable way, e.g. by depositing a plurality of layers, for example a plurality of polymer layers such as a first polymer layer 171, a second polymer layer 172 and a third polymer layer 173. These layers may be patterned as required.

A working chamber 23 is manufactured in any suitable way, e.g. by depositing a plurality of layers, for example a plurality of polymer layers such as a fourth polymer layer 174 and a fifth polymer layer 175. These layers may be patterned as required.

3. Bonding of the Piezoelectric Wafer and the Microfluidic Wafer—FIG. 18.

After providing the piezoelectric devices on the piezoelectric wafer (FIG. 16) and after providing the microfluidic channels on the microfluidic wafer (FIG. 17), these wafers may be bonded to each other. Various bonding materials, such as for example SU8, BCB, can be used for wafer bonding.

After the wafer bonding step, optionally a protective layer (not illustrated in FIG. 18) can be applied depending on the selected release etching process (wet or dry) on the wafer edge area and on other possible etch sensitive zones of the wafer.

The process may then be followed by a release etch for releasing the piezoelectric actuators 121. The release process may start with removing the sacrificial layer 165, e.g. by bulk micromachining methods such as wet etching, e.g. by KOH, or dry etching, e.g. DRIE, RIE or ion beam etching. If a SOI wafer 160 is used for fabrication, the buried oxide layer 163 may act as etch stop layer that will prevent further etching. After subsequent removal of the etch stop layer, e.g. buried oxide layer 163, the piezoelectric actuators 121 can be released. The functional layer 161 may or may not be removed from the structure. The thickness of this layer 161 influences the stiffness of the piezoelectric actuator, and thus has an impact on the maximum displacement and the required actuation voltages per unit displacement.

In all embodiments of the present invention, in particular when they are intended to be used in microfluidic systems including biosensors, biocompatible materials may be used to form the transport channel 22, such as e.g. parylene, PDMS, SU-8, polyimides and other polymers. For biocompatibility, the materials should be chosen such as to comply with the operating conditions and the fluids they are in contact with. Some polymer materials are extremely suitable.

The working fluid in the working chamber 23 may be a fluid, preferably a liquid. In particular embodiments, the working fluid is a substantially incompressible fluid. The working fluid determines the force density (force per unit volume of working fluid). More particularly, the electrical permittivity of the transport fluid influences performance. The higher the electrical permittivity of the working fluid, the higher the force density for the same applied electrode voltage. This means that a lower actuation energy is needed to obtain a higher force density if the working fluid has a higher electrical permittivity. In embodiments of the present invention, the working fluid has a low viscosity. In embodiments of the present invention the material used as a wall of the working chamber 23 has a high breakdown voltage, e.g. for specific polymers, the breakdown voltage may be in the order of a few hundred volt per micrometer gap, typically about 300 V/μm or more.

In particular embodiments of the present invention, the working fluid is a gas, e.g. air, with an electrical permittivity $\in_r=1$. In alternative embodiments, the working fluid is a liquid, with $\in_r>1$. Especially gas bubbles, e.g. air bubbles, can greatly reduce the electrostatic force in such a working fluid for squeezing the channel, because they change the electrical permittivity. It is advantageous that, when using a working fluid with a higher electrical permittivity, the corresponding devices are low-power devices, which can for example be used in mobile applications, such as for example real-time condition monitoring and optimal drug delivery.

Microfluidic devices or micropumps in accordance with embodiments of the present invention may be used for any microfluidic application, such as for example in biosensors, drug delivery, lab-on-a-chip, or cooling applications. Microfluidic devices according to embodiments of the present invention may be used in liquid logic circuits as in WO 2002/081935.

It is to be understood that although preferred embodiments, specific constructions and configurations, as well as materials, have been discussed herein for devices according to the present invention, various changes or modifications in form and detail may be made without departing from the scope of this invention as defined by the appended claims. For example, many other topologies can be thought of, whereby the working fluid builds up pressure into the transport fluid channel 22, the electrodes for increasing the pressure on the working fluid being located against sidewalls of the working chamber 23 away from the transport channel 22. In embodiments of the present invention, functionality may be added or deleted from the block diagrams and operations may be interchanged among functional blocks. Steps may be added or deleted to methods described within the scope of the present invention. Details from embodiments relating to electrostatic actuation may be combined with embodiments of piezoelectric actuation as appropriate. In particular, although not dealt with in detail, also the embodiments relating to piezoelectric actuation may comprise a plurality of working chambers associated with a transport channel. Details of embodiments relating to piezoelectric actuation may be combined with embodiments of electrostatic actuation as appropriate. In particular, although not dealt with in detail, also the embodiments relating to electrostatic actuation may comprise a pressure compensator.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. It should be understood that the illustrated embodiments are examples only and should not be taken as limiting the scope of the present invention. The claims should not be read as limited to the described order or elements unless stated to that effect. Therefore, all embodiments that come within the scope and spirit of the following claims and equivalents thereto are claimed as the invention.

We claim:

1. A microfluidic device comprising:

at least one transport channel;

at least one working chamber, wherein the at least one transport channel and the at least one working chamber are separated from each other by a deformable wall, wherein the at least one working chamber comprises a flexible wall different from the deformable wall, and wherein the at least one transport channel comprises a transport fluid and the at least one working chamber comprises a working fluid; and at least one pair of electrodes, wherein the at least one pair of electrodes are located against sidewalls of the at least one working chamber and away from the at least one transport channel, wherein at least one electrode of the at least one pair of electrodes is provided on the flexible wall, and wherein the at least one pair of electrodes is operable to change pressure on the working fluid such that when the pressure on the working fluid is changed, the deformable wall deforms, resulting in a change of a cross-section of the at least one transport channel, and wherein there is no direct contact between the working fluid and the transport fluid, wherein the at least one working chamber contains a working liquid.

2. A microfluidic device according to claim 1, wherein electrodes of a pair of electrodes of the at least one pair of electrodes are positioned on opposite sides of the at least one working chamber.

3. A microfluidic device according to claim 1, wherein electrodes of a pair of electrodes of the at least one pair of electrodes are positioned at a same side of the at least one working chamber.

4. A microfluidic device according to claim 1, comprising a plurality of working chambers associated with the at least one transport channel.

5. A microfluidic device according to claim 4, wherein at least two working chambers are provided at opposite sides of a transport channel.

6. A microfluidic device according to claim 1, wherein the deformable wall is made from polymer material.

7. A microfluidic device according to claim 1, wherein the at least one transport channel contains a transport liquid.

8. A microfluidic device according to claim 1, wherein the working liquid has an electrical permittivity larger than 1.

9. A microfluidic device according to claim 1, wherein the microfluidic device is used for at least one of a drug delivery application and a medical application.

10. A microfluidic device according to claim 1, wherein the microfluidic device is used for at least one of a cooling application and a lab-on-a-chip application.

11. The microfluidic device of claim 1, wherein the working fluid is a different fluid than the transport fluid.

12. A microfluidic device comprising:

at least one transport channel;

at least one working chamber, wherein the at least one transport channel and the at least one working chamber are separated from each other by a deformable wall, wherein the at least one working chamber comprises a flexible wall different from the deformable wall, and wherein the at least one transport channel comprises a transport fluid and the at least one working chamber comprises a working fluid;

at least one pair of electrodes, wherein the at least one pair of electrodes are located against sidewalls of the at least one working chamber and away from the at least one transport channel, wherein at least one electrode of the at least one pair of electrodes is provided on the flexible wall, and wherein the at least one pair of electrodes is operable to change pressure on the working fluid such that when the pressure on the working fluid is changed, the deformable wall deforms, resulting in a change of a cross-section of the at least one transport channel, and wherein there is no direct contact between the working fluid and the transport fluid; and a pressure compensator in the working chamber a pressure compensator.

13. A micropump comprising a plurality of microfluidic devices, wherein a microfluidic device of the plurality of microfluidic devices comprises:

(i) at least one transport channel;

(ii) at least one working chamber, wherein the at least one transport channel and the at least one working chamber are separated from each other by a deformable wall, wherein the at least one working chamber comprises a flexible wall different from the deformable wall, and wherein the at least one transport channel comprises a transport fluid and the at least one working chamber comprises a working fluid;

(iii) at least one pair of electrodes, wherein the at least one pair of electrodes are located against sidewalls of the at least one working chamber and away from the at least one transport channel, wherein at least one electrode of the at least one pair of electrodes is provided on the flexible wall, and wherein the at least one pair of electrodes is operable to change pressure on the working fluid such that when the pressure on the working fluid is changed, the deformable wall deforms, resulting in a change of a cross-section of the at least one transport channel, and wherein there is no direct contact between the working fluid and the transport fluid, wherein electrodes of a pair of electrodes of the at least one pair of electrodes are positioned at a same side of the at least one working chamber; and (iv) at least one piezoelectric layer, wherein the at least one piezoelectric layer comprises a piezoelectric material, and wherein the at least one piezoelectric layer and electrodes of a pair of electrodes of the at least one pair of electrodes are part of a piezoelectric actuator.

14. A micropump according to claim 13, adapted to be driven as a peristaltic micropump.

15. A micropump according to claim 13, wherein the micropump is used for at least one of a drug delivery application and a medical application.

16. A micropump according to claim 13, wherein the micropump is used for at least one of a cooling application and a lab-on-a-chip application.

17. A method for manufacturing a microfluidic device, the method comprising:

providing at least one transport channel suitable for containing transport fluid;

providing at least one working chamber suitable for containing working fluid, the working chamber having a flexible wall;

providing a common deformable wall between the at least one transport channel and the at least one working chamber, the common deformable wall being different from the flexible wall and configured such that there is no direct contact between the working fluid and the transport fluid; and providing, against sidewalls of the at least one working chamber and away from the at least one transport channel, at least one pair of electrodes for changing the pressure on the working fluid in the at least one working chamber, wherein providing the at least one pair of electrodes comprises providing at least one electrode against the flexible wall, wherein providing at least one pair of electrodes comprises providing at least one pair of piezoelectric electrodes.

18. The method for manufacturing a microfluidic device according to claim 17, wherein providing at least one pair of electrodes further comprises providing at least one pair of electrostatic electrodes.

19. A microfluidic device comprising:

at least one transport channel;

at least one working chamber, wherein the at least one transport channel and the at least one working chamber are separated from each other by a deformable wall, wherein the at least one working chamber comprises a flexible wall different from the deformable wall, and wherein the at least one transport channel comprises a transport fluid and the at least one working chamber comprises a working fluid;

at least one pair of electrodes, wherein the at least one pair of electrodes are located against sidewalls of the at least one working chamber and away from the at least one transport channel, wherein at least one electrode of the at least one pair of electrodes is provided on the flexible wall, and wherein the at least one pair of electrodes is operable to change pressure on the working fluid such that when the pressure on the working fluid is changed, the deformable wall deforms, resulting in a change of a cross-section of the at least one transport channel, and wherein there is no direct contact between the working fluid and the transport fluid, wherein electrodes of a pair of electrodes of the at least one pair of electrodes are positioned at a same side of the at least one working chamber; and at least one piezoelectric layer, wherein the at least one piezoelectric layer comprises a piezoelectric material, and wherein the at least one piezoelectric layer and electrodes of a pair of electrodes of the at least one pair of electrodes are part of a piezoelectric actuator.

20. A microfluidic device according to claim 19, comprising a plurality of working chambers associated with the at least one transport channel.

21. A microfluidic device according to claim 20, wherein at least two working chambers are provided at opposite sides of a transport channel.

22. A microfluidic device according to claim 19, wherein the deformable wall is made from polymer material.

23. A microfluidic device according to claim 19, wherein the at least one transport channel contains a transport liquid.

24. A microfluidic device according to claim 19, wherein the microfluidic device is used for at least one of a drug delivery application and a medical application.

25. A microfluidic device according to claim 19, wherein the microfluidic device is used for at least one of a cooling application and a lab-on-a-chip application.

26. The microfluidic device of claim 19, wherein the working fluid is a different fluid than the transport fluid.

* * * * *